US006224358B1

(12) United States Patent
Musser

(10) Patent No.: US 6,224,358 B1
(45) Date of Patent: May 1, 2001

(54) ROTARY PUMP/TURBINE APPARATUS AND INTEGRATED VALVE SYSTEM

(76) Inventor: Bradley D. Musser, 1107 South Pine, Newton, KS (US) 67114-4841

( * ) Notice: Subject to any disclaimer, the term of this patent is extended or adjusted under 35 U.S.C. 154(b) by 0 days.

(21) Appl. No.: 09/482,041

(22) Filed: Jan. 13, 2000

(51) Int. Cl.[7] ..... F01C 1/12
(52) U.S. Cl. ..... 418/196
(58) Field of Search ..... 418/196, 209, 418/270

(56) References Cited

U.S. PATENT DOCUMENTS 2,097,881 * 11/1937 Hopkins ..... 418/196
3,207,425 * 9/1965 Morse ..... 418/196
3,234,888 * 2/1966 Wise et al. ..... 418/196
3,439,654 * 4/1969 Campbell, Jr. ..... 418/196
5,341,782 * 8/1994 McCall et al. ..... 418/196

* cited by examiner

*Primary Examiner*—John J. Vrablik
(74) *Attorney, Agent, or Firm*—Bradley P. Sylvester

(57) ABSTRACT

An apparatus having the capability to be used as a pump, or as a turbine, or as an engine with an ignition and fuel system, in which four rotors are arranged within a housing to define an inner and outer volume area, with a valve set comprised of rotating members that define various apertures, and which provide venting ports during their rotation about the inner or outer volume areas, where said venting ports vary in their opening size in relation to the rate of volume increase or decrease in the area they are venting. This apparatus is balanced and allows for high speed operation, with the rotating ports arranged during the rotation cycle so that when valve sets are on both ends of the rotors, opposable venting of the inner or outer volume area occurs on the bottom of the apparatus, in the same variable manner as the top valve set.

34 Claims, 24 Drawing Sheets

ROTARY PUMP/TURBINE APPARATUS AND INTEGRATED VALVE SYSTEM

BACKGROUND OF THE INVENTION

Prior art in the area of multiple rotor engines and pumps have sought to create the most efficient apparatus possible. Close tolerances between the moving parts, a maximizing of the displacement within the apparatus, and an improved valve system for the transfer of gases or liquids into the displacement area, have been a continuing effort. Prior inventions have sought to attain the goal of greater efficiency with varying results.

In U.S. Pat. No. 3,207,425 (Morse), an engine with multiple rotors was shown. In this engine, there is interaction between a plurality of rotary piston vanes which are mounted in an offset manner to a revolving member, and where the piston vanes move to increase or decrease the volume of a centrally located area. Incorporated into this invention are a series of valve discs which allow the movements of pressurized gases through the engine. As the vanes are offset, this invention is subject to both revolving and reciprocating unbalances. This invention also only provides for one central area of positive displacement, with any peripheral changes in volume not subject to providing energy through positive displacement.

U.S. Pat. No. 3,234,888 (Wise) was an improvement in rotary pumps, where the vanes, having been described as impellers, revolved around a central shaft that was provided for each impeller. A rather convoluted series of passageways was incorporated into this invention through the impellers, so as to provide for an exchange of pressure between a central area and peripheral area during the pumping process. Rotational movement of the impellers caused the various passage ways to be either blocked on one end or open on both ends to provide an exchange of pressure. This system did not meet the desired efficiency for a rotary pump however, due to the imperfect valve system.

In U.S. Pat. No. 3,439,654 (Campbell), improvements with regard to positive displacement in internal combustion engines was shown. Various intake ports and transfer ports were provided, which allowed pressurized gases to move through the system during operation. Further advancements were seen in U.S. Pat. No. 3,799,126 (Park), in which multiple rotors were shown with an improved orientation to each other. Valve port assemblies were described as being open to one separate compartment only at any one time, and the ports themselves were defined in part by the rotors, in that no separate port opening and closing apparatus was used apart from said rotors.

Further development is seen in U.S. Pat. No. 4,324,537 (Meyman), in which a plurality of rotors were used to provide compression during rotational movement. Rotors in this invention were more triangular shaped than elliptical. A separate disk was provided which allowed an inlet and outlet port to be rotated around the revolving rotors to provide access to the central and peripheral cavities. In this invention, a single rotating disk is used, which was an improvement over prior inventions, but still did not meet the desired efficiency between rotors and valve system operations.

U.S. Pat. No. 4,422,836 (Meyman), also showed a rotary machine which depicted improvements in an end face sealing plate. This invention had the drawbacks of undesired wear on the end bases of the rotors and covers. No new improvements in intake ports and/or exhaust ports were given.

Further inventions sought to expand on the idea of an improved valve system. In U.S. Pat. No. 4,934,325 (Snyder), a rotary internal combustion engine was shown, in which four adjacent rotors were provided with hollow interior flow passages that allowed communication of pressure changes between the central and peripheral areas within the housing.

U.S. Pat. No. 5,341,782, (McCall) depicted a rotary internal combustion engine, which was provided with four oval shaped rotors. Two of these rotors had a truncated end to periodically open the working volume to exhaust gases and to intake fresh air. This invention did not allow for a maximizing effect of the gas exchange between the interior and the exterior areas around the rotors. This invention would not operate as effectively as desired for purposes of pumping liquids or gases, since the design and operation of the rotors require an increase of pressure before any venting could occur.

An invention which allows for close tolerances between revolving rotors, a maximized displacement, and a coordinated valve system will provide the greatest efficiency. This invention is directed to these goals, having a coordinated improved valve system to accommodate a maximum displacement, and rotor configuration.

SUMMARY OF THE INVENTION

Figure 1:
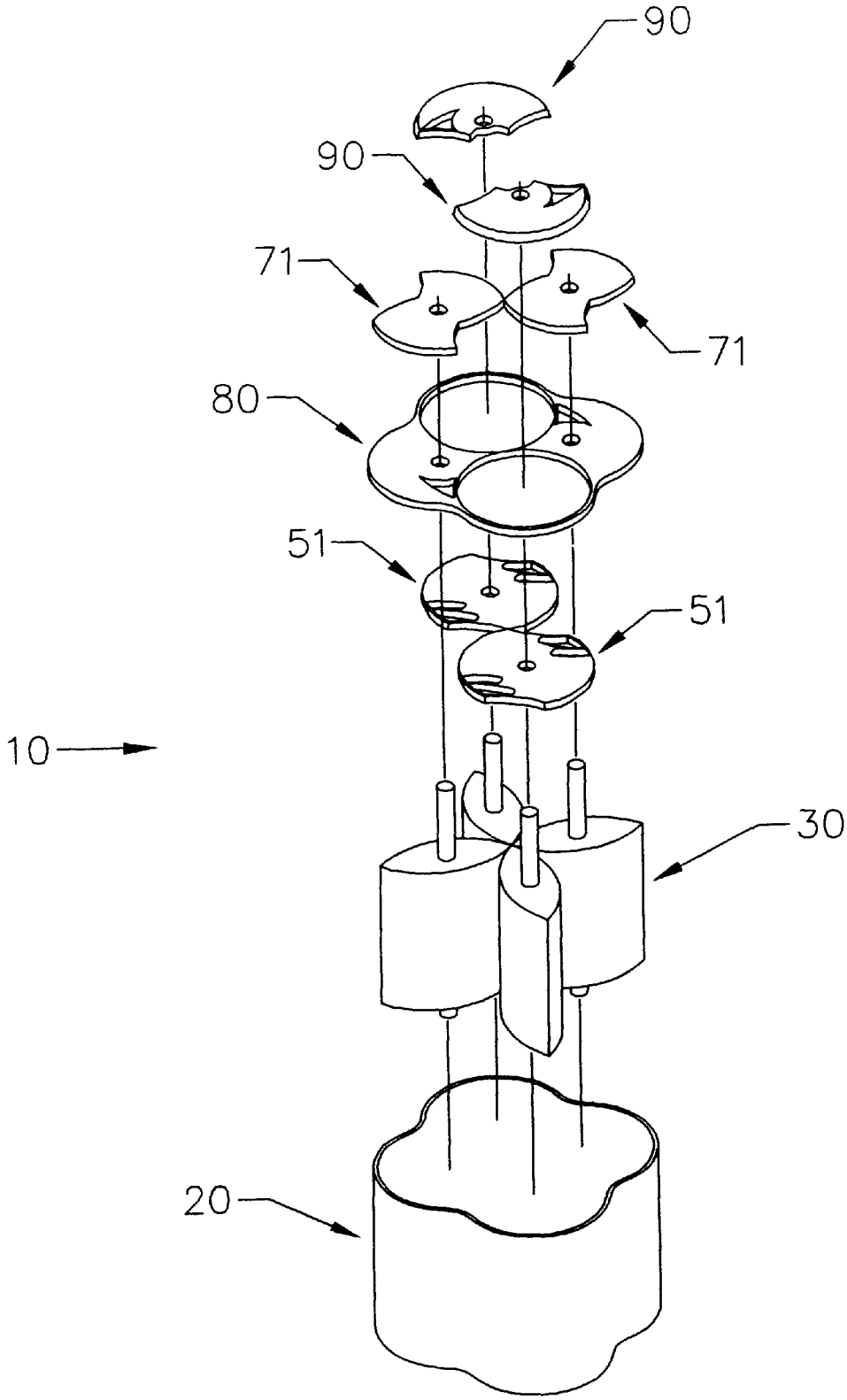
FIG. 1 is an exploded perspective view of the apparatus, in which the rotors are shown as having pointed sealing edges.

This invention comprises a rotor set and valve system, situated within a housing, where the rotation of the rotor set causes various apertures to allow venting into an internal and external volume area. This invention has the ability to function as an engine, where the expanding and decreasing volumes, and the valve system are able to be used together with an ignition and fuel delivery system to provide energy delivered through an input/output shaft. For purposes of this discussion, the invention is described in terms of the pumping and turbine properties it has to offer.

The valve system offers maximum efficiency, with a varying inlet/outlet port size, which changes in conjunction with the rate of expansion or compression of the volume area it is venting to. The valve system is able to work with the invention as a pump, a turbine, or as an engine. The components of this invention are all able to be balanced so that there is virtually no revolving unbalance during operation, which will minimize frictional wear, and allow high speed operation.

Four rotors, which each rotate around a centralized shaft, comprise a rotor set, and are situated within a housing. The adjacent rotors are positioned at 90 degrees from each other, with the opposing rotors positioned 180 degrees from each other. All four rotors move simultaneously in the same rotational direction. As these rotors move, an internal volume displacement area, defined as an area completely surrounded by the rotors, expands or contracts while at the same time an external volume displacement area, being the area between the rotors and housing, contracts or expands in a total volume opposite to that of the internal volume area.

A valve system, comprising a pair of primary top disks that rotate within an end plate, and a pair of secondary top disks which are fixed to the top and bottom of the rotor set, and cover plates, fixed in position, which jointly allow fluid or gas transfer into and out of the internal and external volume areas at specific times during the rotational cycle. The primary top disks are attached to an opposing set of rotor shafts and rotate within circular managers defined by the end plate.

A second opposing pair of rotor shafts protrude through designated openings in the end plate, and rotate secondary top disks, which function as covers or restriction means for the vent openings.

When all four rotors are positioned so that their sealing edges are immediately adjacent to one another, the internal volume area will be at a minimum, while the external volume area between the rotors and the housing will be at a maximum volume. As the rotors turn in the same direction, they will begin to expand the volume of the internal volume area, while concurrently diminishing the volume at the same rate in the external volume area.

As volumes in both the internal volume area and external volume area increase and diminish, the valve assembly will provide ports through which fluids or gases are able to move through into respective internal or external volume areas. As the rotors continue to turn, the volume of one area will reach a maximum, while concurrently the other volume will reach the minimum. As the rotors continue to turn, the maximum volume area will begin to diminish, while at the same rate, the other volume area will begin to expand. During this expansion and diminishing volumes, the ports are opened and closed at designated time intervals during the rotor rotation, so as to allow fluids or gases to move into areas of lower pressure, the operation of which will be further explained below. One novel aspect of this invention is that the port size, being the amount of venting transfer that can occur, will vary during rotation, to coordinate with the rate of expansion or reduction of volume.

It is this arrangement of openings that function as ports of exchange, where said ports are optimally positioned over their respective volume areas at prescribed times so as to maximize the flow of gas or liquid through this system. Accordingly, it is an object of this invention to provide a pumping apparatus that allows the maximizing and minimizing of the volume areas, while providing a means to allow liquid or gas to move into expanding volume areas and be expelled out of diminishing volume areas.

Accordingly, it is a further object of this invention to provide an efficient valve system, which works with a set of four rotors, to provide a inlet/outlet venting valve port that changes in size in coordination with the amount of gas or liquid exchange that is required during the progression of the rotation.

Accordingly, it is a further object of this invention to allow a maximum exposure of the volume areas to the surrounding liquids or gases during the pumping process, so as to maximize the flow of material through pumping system, without the requirement of using energy to create a necessary high-pressure volume areas or negative pressure volume areas.

Accordingly, it is a further object of this invention to allow a set of rotors, positioned so as to have as close of tolerances to each other as possible, and with a maximized displacement volumes, coordinated with an improved valve system, so as to allow for greater efficiency.

DETAILED DESCRIPTION OF THE PREFERRED EMBODIMENT

Referring now to FIG. 1, an exploded view of the improved compressor/turbine 10, hereinafter referred to as the "apparatus" is shown. FIG. 1 provides a general overview, and the specific parts mentioned will be described in much greater detail below.

As is shown in FIG. 1, a rotor set 30 is able to be contained within housing 20. Primary top disks 51 are slid down over primary shafts 37 and rotate within apertures defined by an end plate 80. Secondary top disks 71 are situated above, and are slid down over secondary shafts 38, situated between the end plate 80 and cover plates 90, where cover plates 90 are also fixed to the end plate 80.

Figure 2:
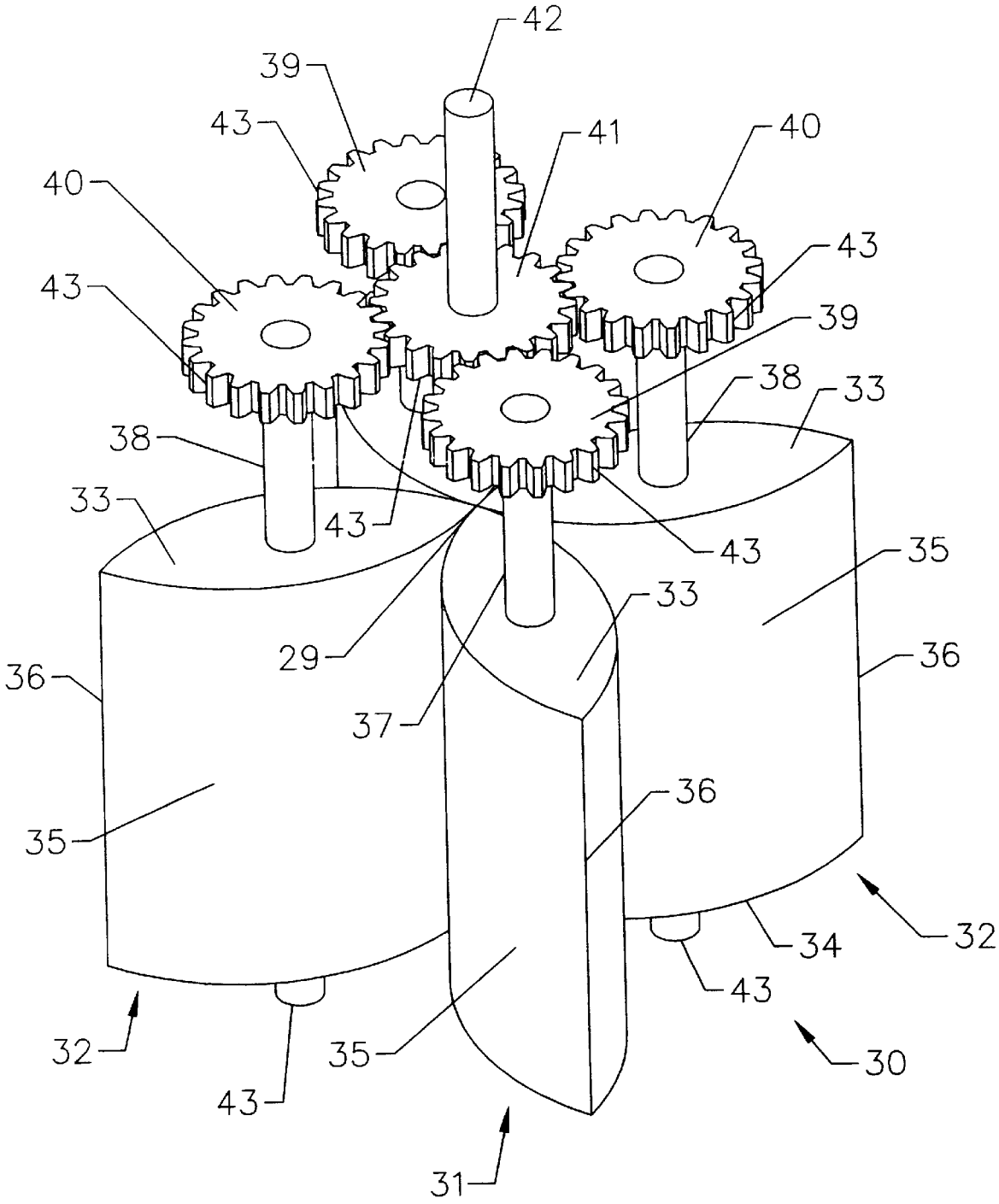
FIG. 2 is a perspective view of the rotor set and accompanying gears, which fit within the housing.

Referring now to FIG. 2, the rotor set, comprising primary rotors 31 and secondary rotors 32 are shown. Although various gears 39, 40, and 41 are shown, they will be described in greater detail below, separate from this portion of the description. The primary rotors 31 and secondary rotors 32 comprise the rotor set 30, with each rotor having a cross sectional elliptical shape, having opposing arcual sides 35 that terminate as sealing edges 36. The rotors 31 and 32 are preferably constructed of a hardened material that is rather impervious to frictional wear. Each rotor 31 and 32 has a top side 33 and a bottom side 34. A centrally located primary shaft 37 extends outward from the top side 33, with the primary shaft 37 likewise extending outward below the bottom side 34.

A secondary shaft 38 extends upward from the top side 33 of the secondary rotor 32, with the secondary shaft bottom end 43 also shown extending downward below the bottom side 34 of the secondary rotor 32. The primary shafts 37 and the secondary shafts 38 are parallel to each other. The primary rotors 31 are oriented so that they have a difference of 90 degrees of rotation, as compared to the secondary rotors 32. As is shown in FIG. 2, one sealing edge 36 of both primary and secondary rotors 31 and 32 are all adjacent to each other at a central point 29, which provides a minimal defined volume between the primary rotors 31 and secondary rotors 32 which comprise the complete rotor set 30.

Figure 3:
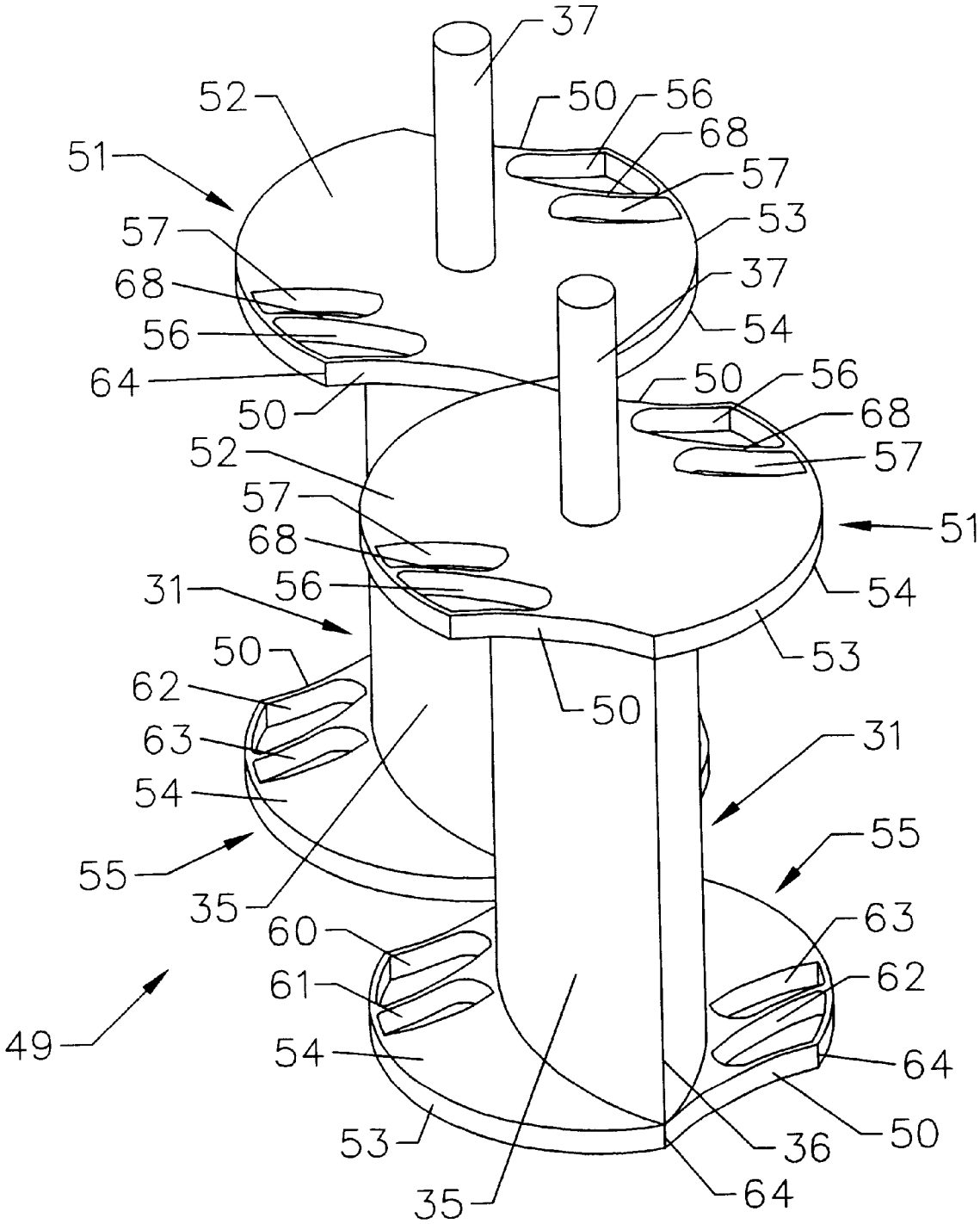
FIG. 3 is a perspective view of the two primary rotors, with the primary top and primary bottom disks secured onto the primary shafts.

Referring now to FIG. 3, the primary group 49, comprising both primary rotors 31 and primary top disks 51 and primary bottom disks 55, is shown. The primary top disk 51 and primary bottom disk 55 are identical, except that they are inverted from one another. FIG. 3 depicts the position of the primary rotors 31 as they are shown in FIG. 2. FIG. 3, as compared to FIG. 2, shows the addition of primary top disks 51, but the secondary rotors 32, their secondary rotor shafts 38 and gears 39–40 have been removed for clarity. In FIG. 3, each primary rotor 31 is configured so that one of its sealing edges 36 are placed in close proximity to the other primary rotor 31 in the manner shown in FIG. 2. Attached to the primary rotors 31 are primary top disks 51, which are placed on both of top edges 21 of the primary rotors 31, so that their external sides 52 comprise the top most side of this primary group 49.

The primary top disks 51 are comprised of a sheet of material that defines a circumferential edge 53 with two opposing inverse arcual edges 50, that employ a notch in an otherwise round disk, with each edge 50 set at 180 degrees from each other around the circumferential edge 53. Aperture A 56 is defined as an opening through the thickness of the primary top disk 51, being defined as an opening that is adjacent to both the inverse arcual edge 50 and the circumferential edge 53. Aperture A 56 has a generally triangular shape with sides that follow both the inverse arcual edge 50 and the circumferential edge 53, and with a third side that is defined as the side connecting the ends of the aforementioned sides.

Aperture B 57 is located immediately adjacent to aperture A 56, where said apertures 56 and 57 are separated by a divider wall 68. Aperture B is also defined as an opening through the thickness of the disk 51 and 55, having dimensions that follow along the divider wall 68 and the circumferential edge 53, and where aperture B 57 is an elongated opening.

A second set of apertures A and B are defined by the disk 51 and 55, set at 180 degrees from the aforementioned set of apertures A and B 56 and 57, about the shaft 37. The second set of apertures A 56 and B 57 have the same configuration to the inverse arcual edge 50 they are adjacent to, as do the aforementioned aperture A 56 and aperture B 57.

Each defined characteristic of the disks 51 and 55 are defined at 180 degrees from each other. The primary shaft 37 extends through the center of the primary disks 51 and 55 and primary rotors 31, so that the shaft 37 can be rotated very quickly and the combination of primary rotors 31, primary disks 51 and 55 and primary shafts 37 will maintain the proper revolving balance necessary for high-speed function.

Figure 5:
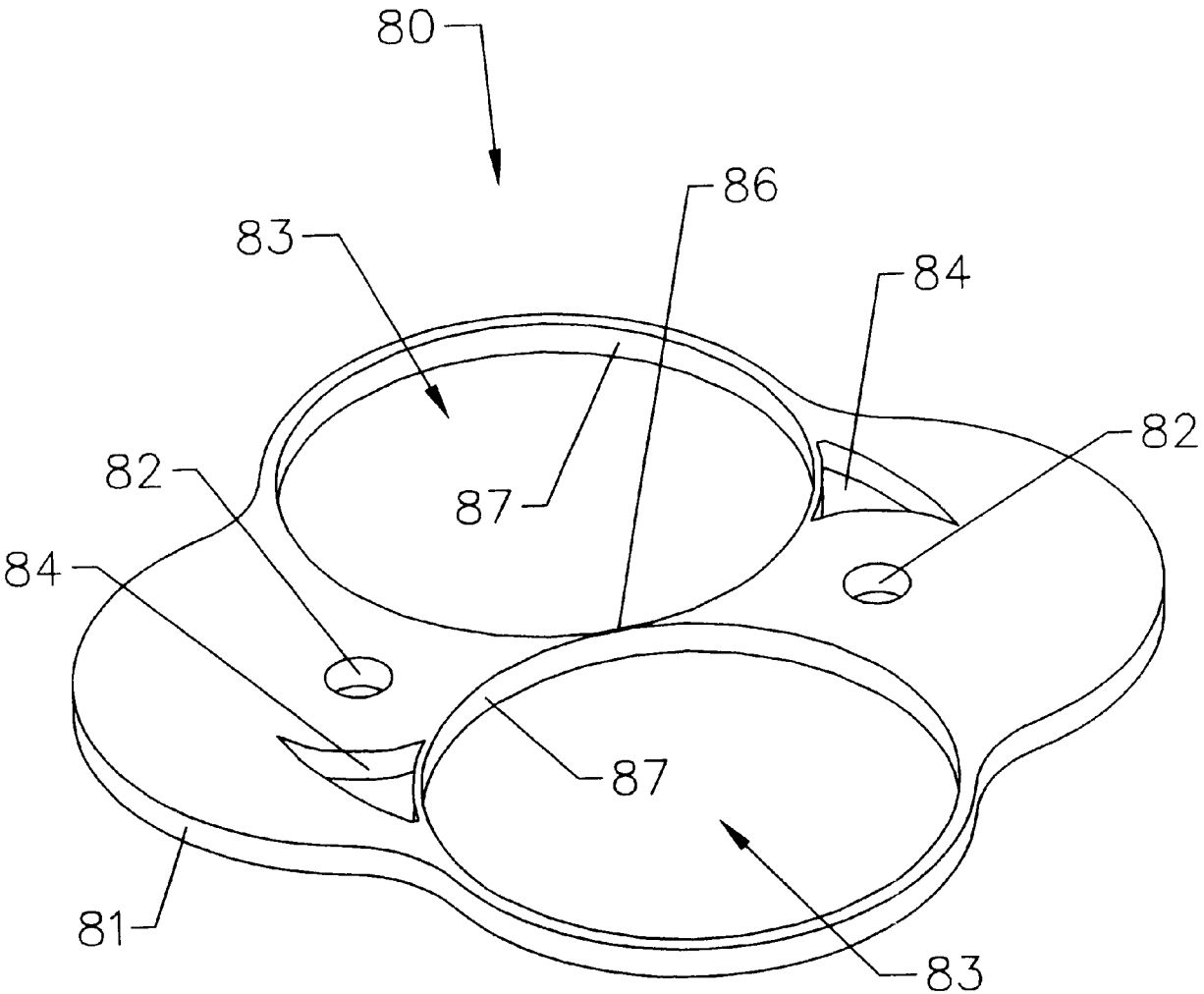
FIG. 5 is a perspective view of the end plate.

Referring now to FIG. 5, an end plate 80 is shown, defining secondary shaft holes 82, a set of triangular shaped end plate stationery apertures 84, and adjacent primary disks guides 83, comprising circular apertures, having an inner surface circumference 87 that is closely match by the circumferential edge 53 of the primary top disk 51 described above. When using rotors 31 and 32 that have pointed sealing edges 36, the defining wall 86 that separates each primary disk guide 83 is as thin as possible between the two primary disk guide areas 83, as the less space between the two primary disk guides 83, the more efficiently this apparatus 10 will function.

It should be also noted that the placement of the secondary shaft holes 82 would be bisected by an imaginary line that would travel directly between the primary disk guides 83. The end plate stationery apertures 84 are defined as openings through the thickness of the end plate 80 and which have arcual sides, one of which follows a line of radius slightly greater than the radius than that which defines the limit of the primary disk guide 83.

Figure 8:
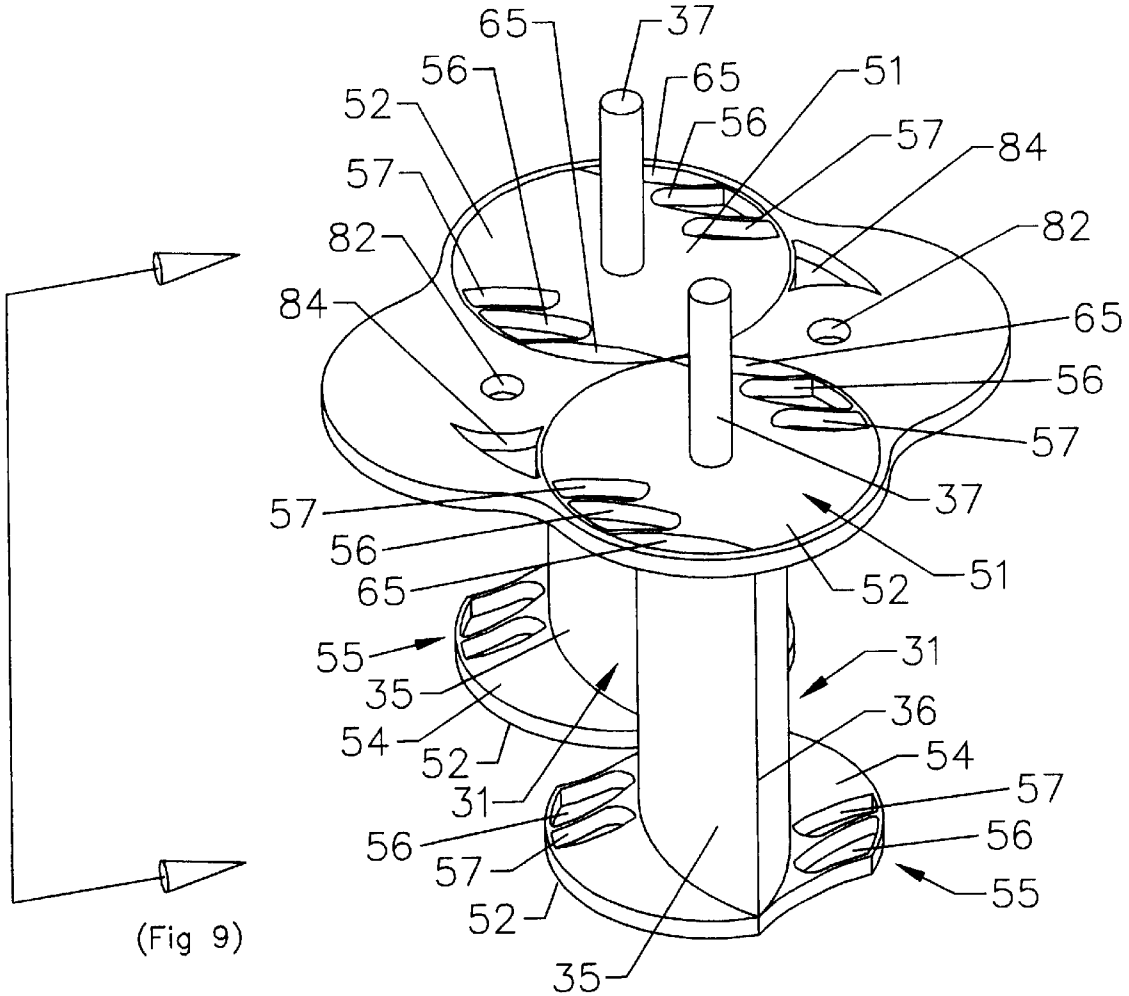
FIG. 8 is a perspective view of the primary rotor set and top disks, disposed within the primary disk guides of the top end plate.
Figure 9:
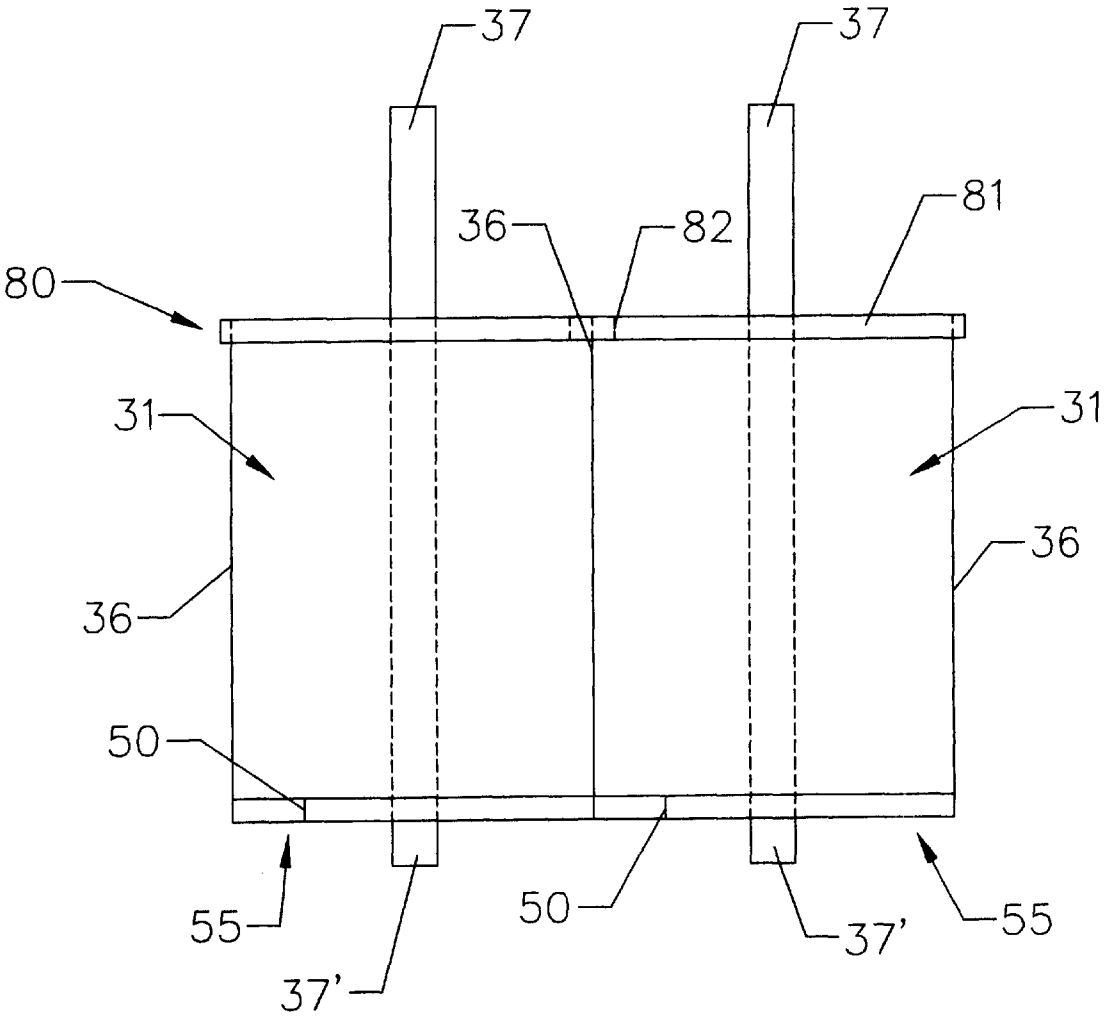
FIG. 9 is a side cross-sectional view of FIG. 8.

Referring now also to FIGS. 8 and 9, a view of the primary rotors 31, and the end plates 80 in combination are shown. As was previously stated and described in FIG. 3, the primary top disks 51 and primary bottom disks 55 are fixed to the primary rotors 31, with the primary top disk 51 and primary bottom disk 55 each placed within a primary disk guide area 83 of an end plate 80, which is then placed on both the top and bottom of the primary rotors 31. It is not required that the bottom of this assembly have primary bottom disks 55, or any type of disk guide 80, where another type of valve system is used, but either the top portion or bottom portion of this apparatus 10 must have this configuration. Optimally, both the top and bottom of this apparatus 10 will have the full valve configuration, so that the arrangement as seen from a top view will match the arrangement as seen from the bottom view.

As FIG. 8 shows, the primary rotors 31 are side-by-side, and as will be more fully shown and described below, rotate in the same manner at the same time, so that they both are oriented in the same direction and degree of turning about their primary shafts 37. The orientation of the primary top disks 51, with regard to each other, is that they both occupy identical positions, and with the inverse arcual edge 50 providing a gap 65 which functions as an additional aperture when the primary top disk 51 is positioned in the primary disk guide area 83.

As is shown in FIG. 8, the primary top disk 51, with its apertures 56 and 57 and gaps 65, oriented at 180 degrees from each other about the primary shaft 37, each present openings to different arcual sides 35 of primary rotors 31 toward opposite sealing edges 36. As it is also shown in FIG. 8, the bottom primary disks 55 are identical to the top primary disks 51, with the exception that they are upside down in relation to the top disks 51, and have been rotated 90 degrees, and are opposably situated to one another, so that the external side 52 of any disk 51 is likewise presented as an external side 52 of the bottom primary disk 55. The bottom primary disk 55 presents its various apertures 56 and 57, adjacent to opposite arcual sides 35, at 180 degrees from each other as determined from the center of the primary shaft 37. Since the top primary disks 51 and bottom primary disks 55 are identical, the disks 51 and 55 are attached so that one is upside down as compared to the other, they jointly present their apertures 56 and 57 along a fixed point of rotation adjacent to the shaft 37 every 90 degrees of rotation.

As FIG. 9 shows, a side view of the end plates 80 will only give a view of the outer edge 81, as the thickness of the end plate 80 is equal to or in excess of the thickness of the primary top disk 51 or primary bottom disk 55. The purpose of the end plate is to cover the open end of the housing 20, in conjunction with the valve set. As will be discussed below, with regard to FIG. 14, the thickness of disks 51 and 55, and the end plate 80, should be identical. The primary shaft 37 protrudes outward on both the top and bottom of this primary rotor set 49.

Figure 4:
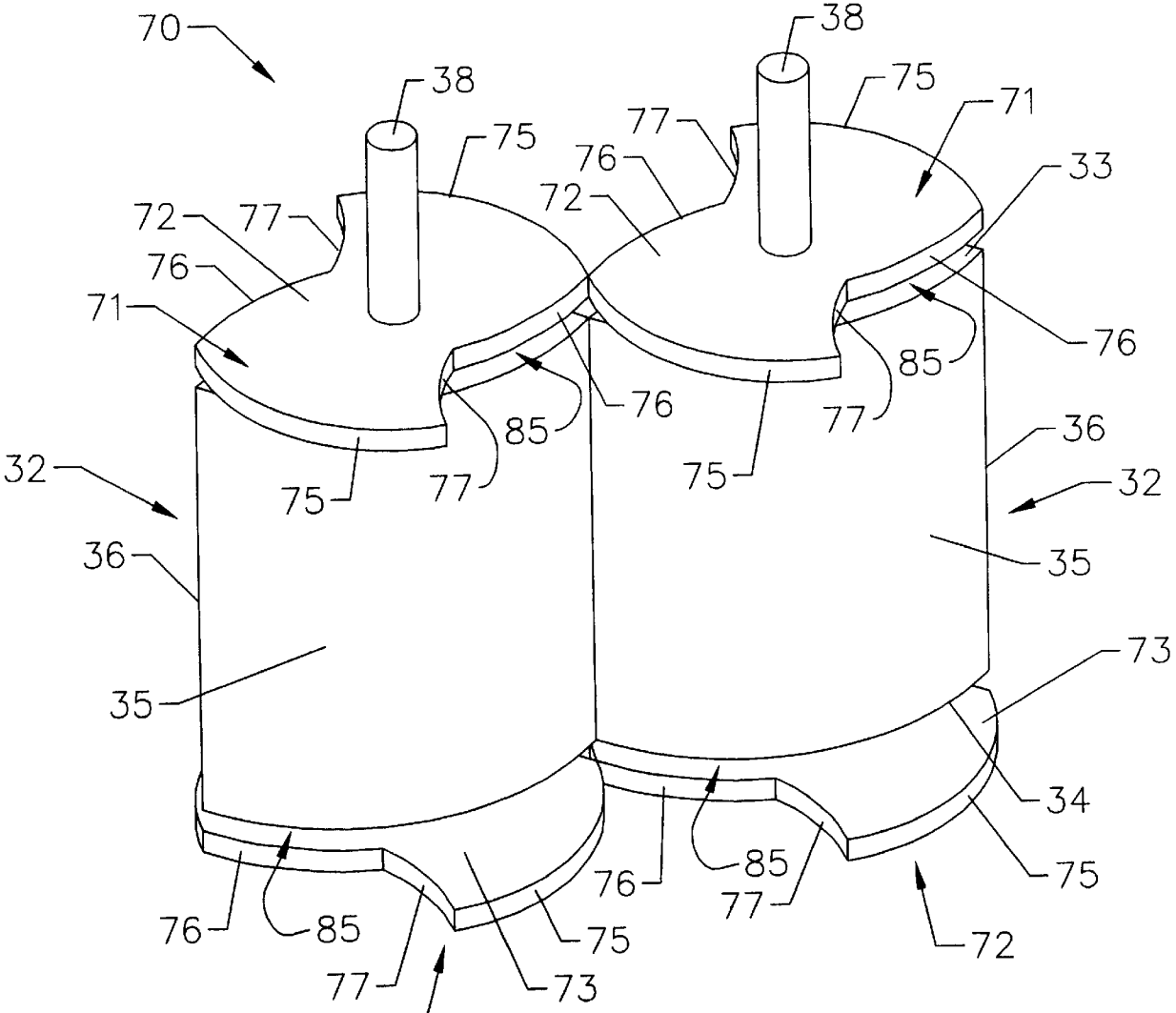
FIG. 4 is a perspective view of the secondary rotor set, with the secondary top and bottom disks fixed to the secondary shafts.

Referring now to FIG. 4, the secondary group 70 is shown. FIG. 4 shows the secondary rotors 32 in this configuration as shown in FIG. 2. FIG. 4, as compared with FIG. 2, has the addition of secondary top disks 71, and secondary bottom disks 72, but has removed the primary rotors 31 and gears 39 and 40 for clarity.

The secondary group 70 comprises the secondary rotors 32, which have a secondary top disk 71 and secondary bottom disk 72 attached on either end of the rotor 32, on the shaft 38 which extends through the center of the disks 71 and 72 and secondary rotors 32. The position of the secondary shaft 38 allows each secondary rotor 32 and top and bottom secondary disks 71 and 72 to rotate about the secondary shaft 38 with minimal rotational unbalance.

The secondary top disk 71 and bottom disk 75 are identical in shape, but are inverted to each other in the same manner as that described for the primary top and bottom disks 51 and 55. The secondary disks 71 and 75 have a bow tie shape with outer circumferential edges 75 that follow the imaginary line of a circle having a continuous radius about the centrally located secondary shaft 38. A wide V-shape notch is defined on each opposing side of the secondary top disk 71, defined by a slightly convex edge 76 and a slightly concave edge 77. Each convex edge 76 is located 180 degrees from a similarly situated convex edge 76, and each concave edge 77 is located 180 degrees from a similarly situated concave edge 77.

As is shown in FIG. 4, the convex edge 76 follows the same arcual path as does the arcual side 35 of the secondary rotor 32. Each convex edge 76 follows the same arcual path as the arcual side 35 of each secondary rotor 32 which it is positioned adjacent to.

The secondary top disks 71 and secondary bottom disks 72 are identical in configuration. As is shown in FIG. 4, the placement of the concave edge 77 and convex edge 76 on the secondary bottom disks 72 are opposite that of the secondary top disks 71, and the identical disks 71 and 72 are attached so that the internal side 73 of the top disk 71 is the same defined side for the bottom disk 72, as the bottom disk 72 is upside down as compared with the top disk 71.

During a clockwise rotational cycle, a leading convex edge 76 of the bottom secondary disk 72 will be followed in rotation by a concave edge 77 on the top secondary disk 71, followed by a concave edge 77 of the bottom secondary disk 72, followed by a convex edge 76 of the secondary top disk 71.

As is shown in FIG. 4, the placement of the secondary top disk 71 and secondary bottom disk 72 are along the length of the secondary shaft 38 so that a small gap 85 exists between each disk 71 and 72 and secondary rotor 32. As will be seen and explained further below, the gap 85 must be sufficient so as to allow the placement of the end plate 80 and primary disks 51 and 55 between each rotor 32 and its respective disk 71 or 72. Referring back again to FIG. 1, the secondary top disk set 71 is placed above the end plate 80 which have the top disks 51 situated within them.

Figure 10:
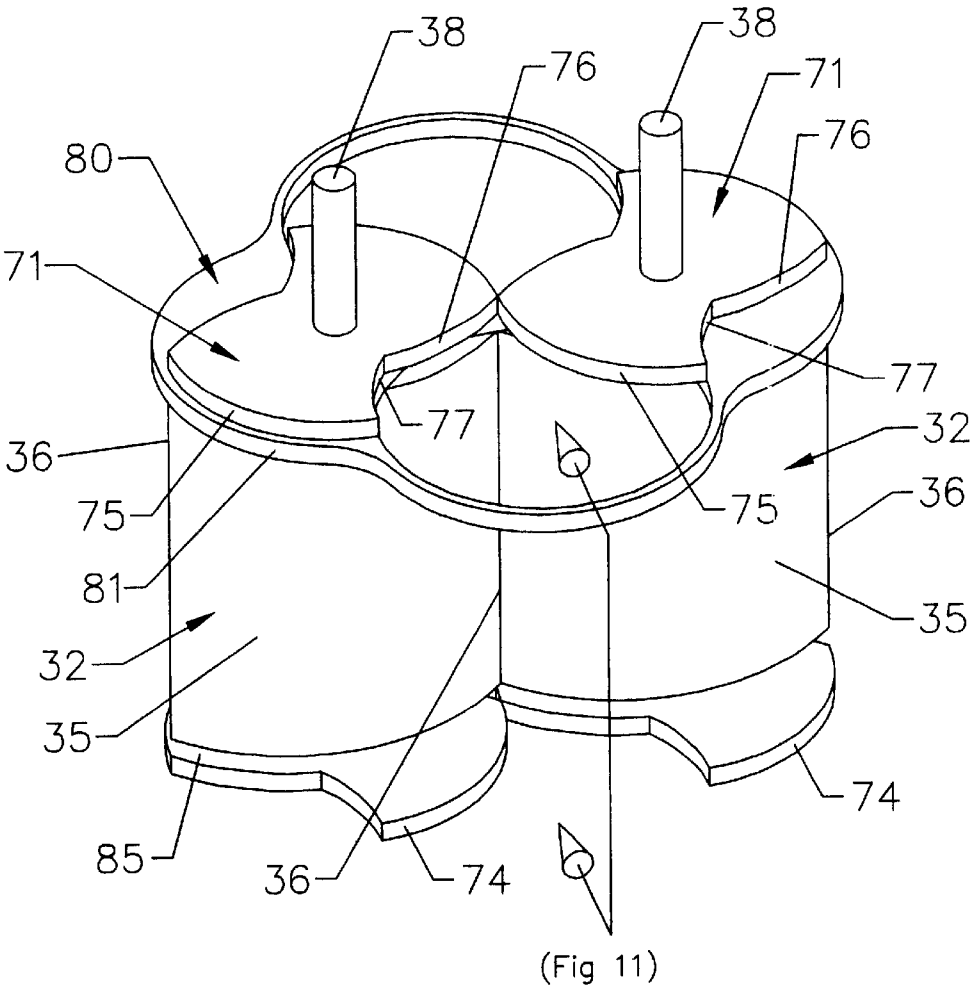
FIG. 10 is a perspective view of the rotors, adding the secondary top disks and end plates situated above a pair of rotors.
Figure 11:
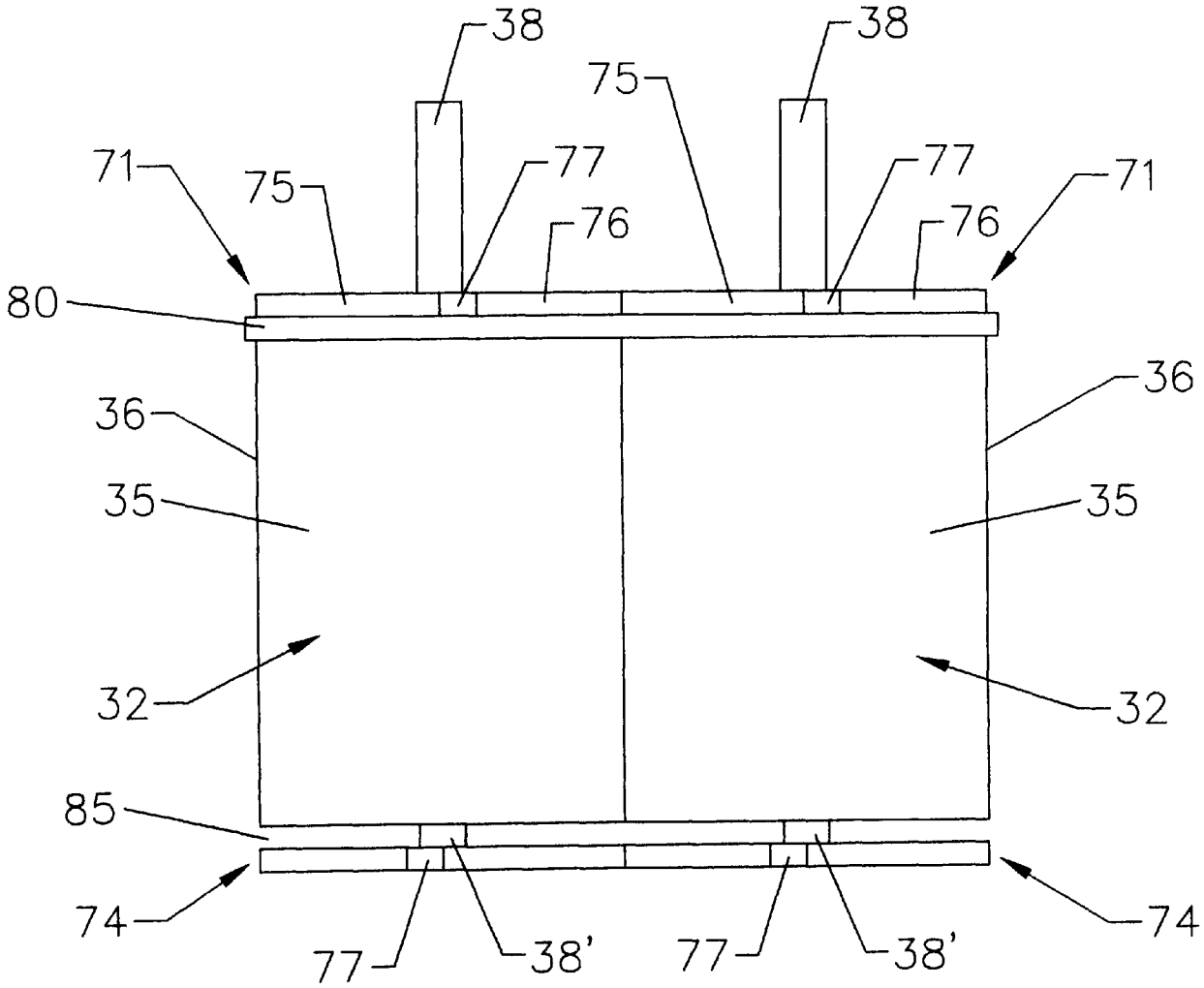
FIG. 11 is a side cross-sectional view of FIG. 10.

Referring now to FIG. 10, and FIG. 11, where FIG. 11 depicts a view shown along designated arrows in FIG. 10, the orientation of the secondary rotors 32, and the secondary shafts 38 which protrude through the secondary shaft holes 82 of the end plate 80 are shown. The end plate now occupies the gap 85, as referred to and shown in FIG. 4. The placement of the secondary top disks 71 is after insertion of the shafts 38 through end plate 80. As is shown in FIG. 11, the end plate 80 is placed on top of rotors 32 and which is occupying the entire gap 85, where said gap 85 is shown on the bottom of said rotors 32 in FIG. 11.

Figure 6:
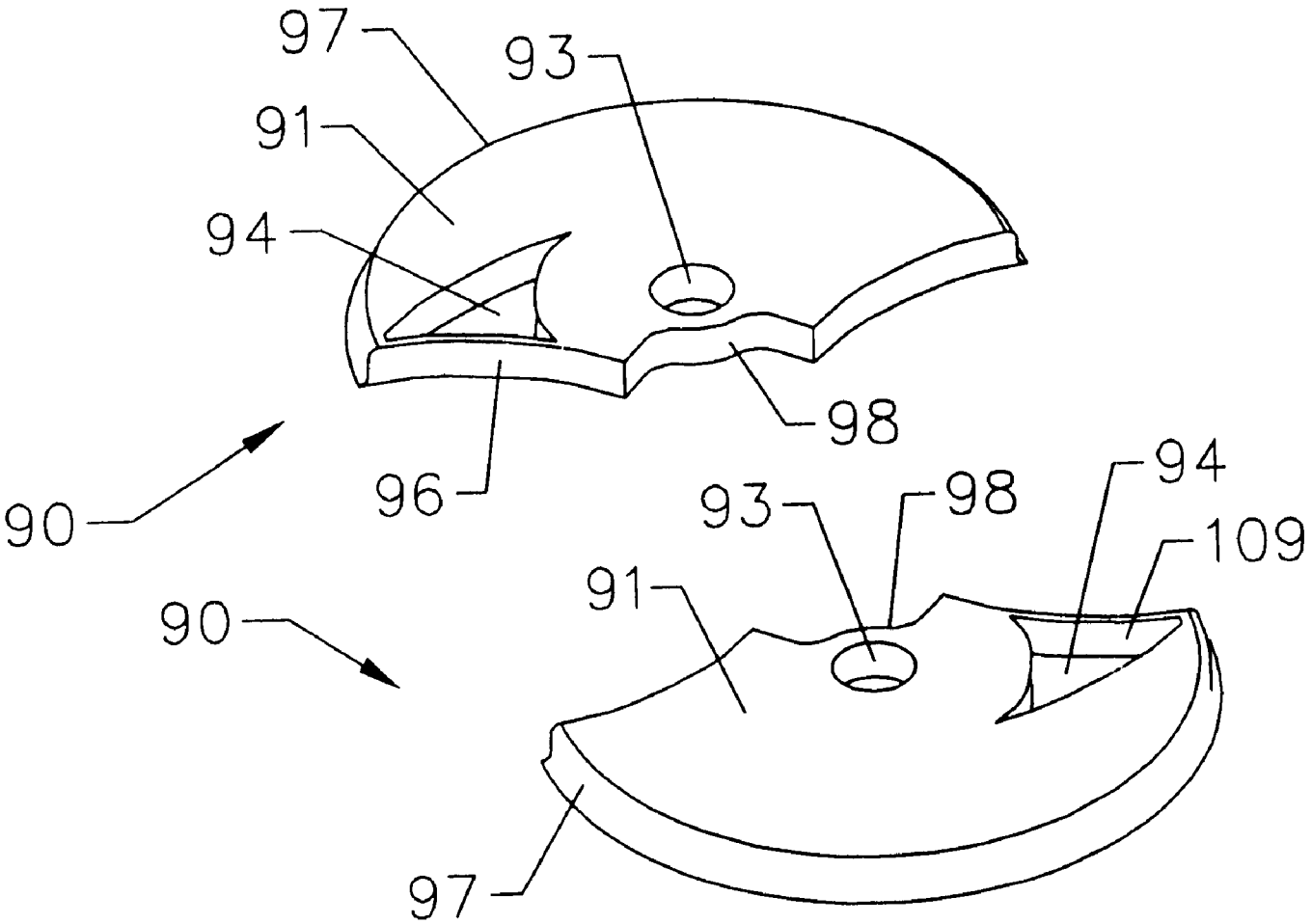
FIG. 6 is a perspective view of the set of cover plates.
Figure 7A:
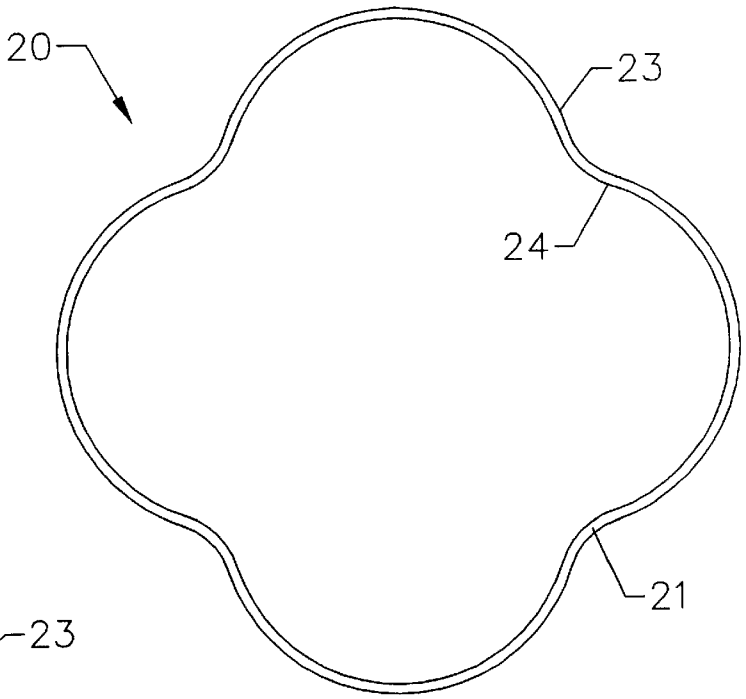
FIG. 7A is a top view of the housing.
Figure 7:
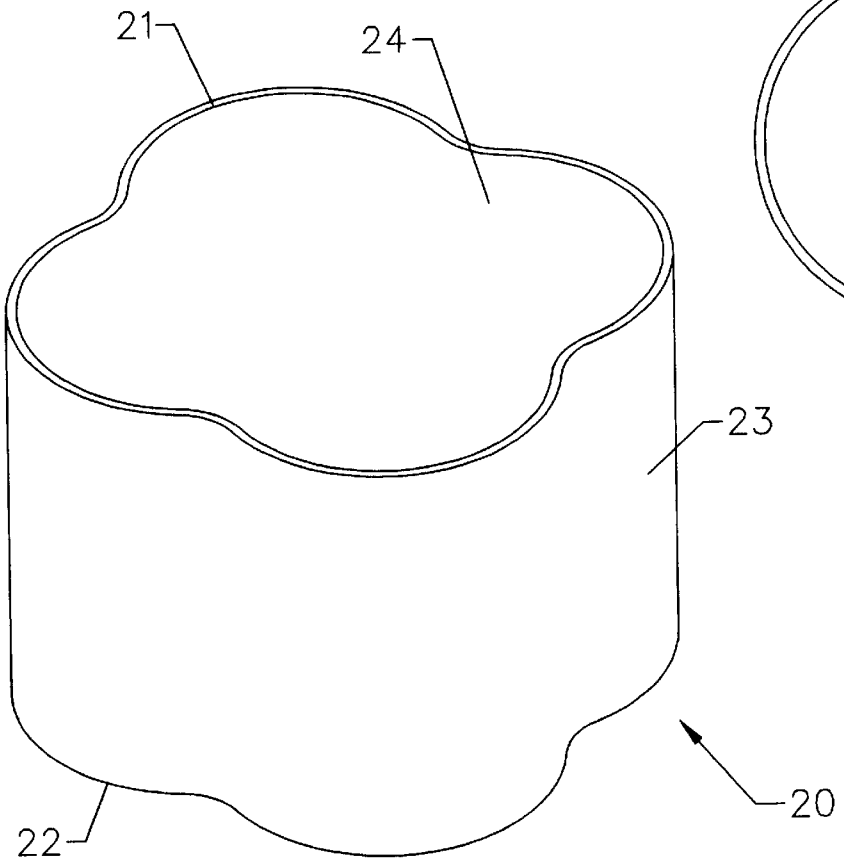
FIG. 7 is a perspective view of the housing.

Referring now to FIG. 6, two opposing cover plates 90 are shown. FIG. 6 shows the general orientation of the cover plates 90 as they would be in relationship to each other when initially placed over the primary shafts 37, with the primary shafts 37 configured as shown in FIG. 1 and FIG. 2. The primary shafts 37 extend through the primary shaft hole 93, which is defined as an opening through the thickness of the cover plate 90.

Each cover plate 90 is comprised of a partial ring portion, having a cut out 98 with arcual curved edges 96 extending from the cut out 98 to an outer edge 97 which preferably has a circumference along a constant radius from the center of the primary shaft hole 93. Also defined along one curved edge 96, is a triangular shaped cover plate stationery aperture 94, which is an opening through the thickness of said cover plate 90.

Figure 12A:
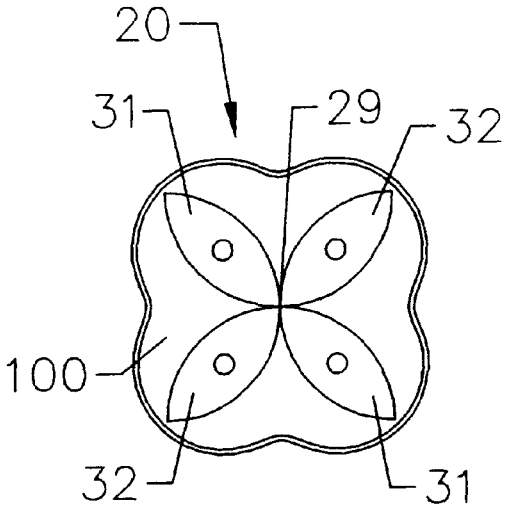
FIG. 12A is a top view of the rotor set and housing, where the rotors define a minimal internal area, and where the rotors are defined as being at zero degrees rotation.

The movement of the rotors 31 and 32 in relation to each other is shown in FIGS. 12A through 12L. Each successive figure shows rotation of the rotors 31 and 32 at increments of 15 degrees. As it is shown in FIG. 12A, all rotors 31 and 32 are positioned within the housing 20 so that each rotor 31 or 32 has a sealing edge adjacent to the housing 20, so as to create what appears to be four separate external volume areas 100. It is not necessary for the rotors to be in close proximity to the housing 20 for this apparatus to work efficiently, and therefore the external volume area 100 remains a single contiguous volume about the rotors 31 and 32. The other sealing edge 36 on each rotor 31 and 32 are adjacent to each other at a central point 29, in which the internal volume area 99 is theoretically nonexistent, or having such a small volume that it is not apparent in FIG. 12A.

Figure 12B:
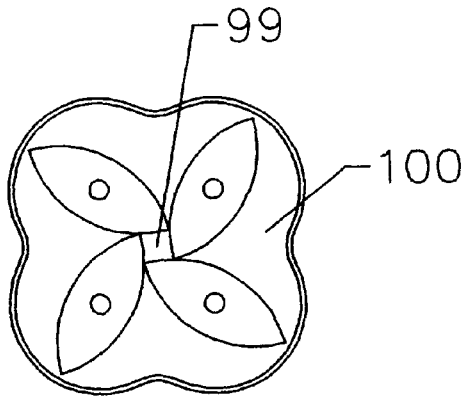
FIG. 12B is a top view of the rotor set and housing, where the rotors have turned 15 degrees from FIG. 12A.

As is shown in FIG. 12B, as a rotation of 15 degrees occurs about the shafts 37 and 38, the internal volume area 99 begins to increase, as the sealing edges 36 of rotors 31 and 32 move adjacent to arcual sides 35 of adjacent rotors 31 or 32, defining an elongated volume area 99 which is sealed from the external volume area 100, by the close contact of the sealing edges 36 against the arcual sides 35. The total volume of the external volume area 100 will decrease in the amount of the increase of the internal volume area 99.

Figure 12C:
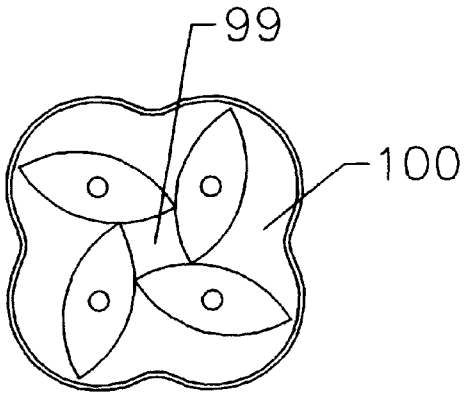
FIG. 12C is a top view of the rotor set and housing, where the rotors have turned 30 degrees from FIG. 12A.

As the rotors 31 and 32 rotate an additional 15 degrees, as shown in FIG. 12C, the sealing edges 36 continue to move adjacent to the arcual sides 35 of the adjacent rotors 31 or 32, so that the internal volume area 99 continues to increase, while the external volume area 100 continues to decrease in like amount.

Figure 12D:
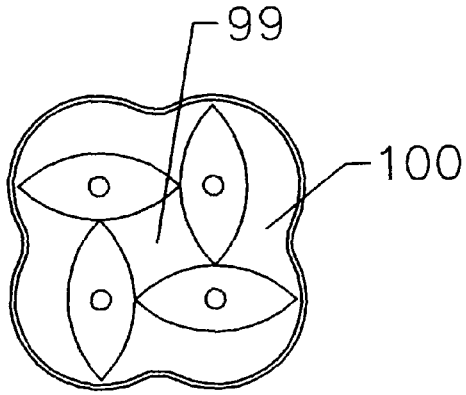
FIG. 12D is a top view of the rotor set and housing, where the rotors have turned 45 degrees from FIG. 12A.
Figure 12E:
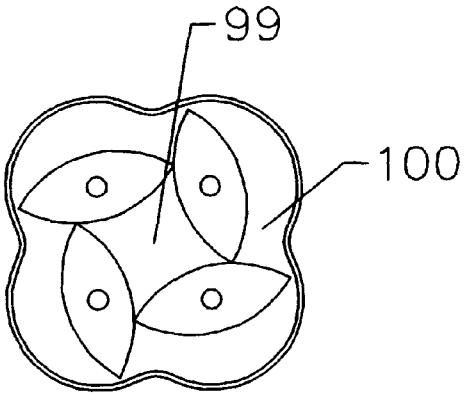
FIG. 12E is a top view of the rotor set and housing, where the rotors have turned 60 degrees from FIG. 12A.
Figure 12F:
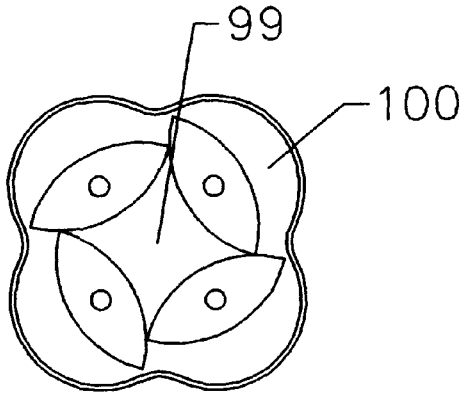
FIG. 12F is a top view of the rotor set and housing, where the rotors have turned 75 degrees from FIG. 12A.

FIG. 12D shows an additional rotation of 15 degrees, as compared with FIG. 12C, where the internal volume area 99 has increased, with the external volume area 100 decreasing in like amount. FIGS. 12E and 12F show an additional amount of rotation of 15 degrees respectively, and again show the internal volume area 99 increasing, with the external volume area 100 decreasing in like amount. It should be noted, that one of the sealing edges 36 of each rotor 31 and 32 is moving adjacent to the arcual side 35 of the adjacent rotor 31 or 32, which provides a resilient seal between the internal volume area 99 and the external volume area 100.

The housing 20 may have any configuration, and the pumping effect may rely completely on the expansion or decreasing of the inner volume area 99 alone, but preferably, the housing 20 will have the configuration shown, where four semicircular curves define the extent of the inner volume area 100, where the sealing edges 36 of the rotors 31 and 32 are able to move adjacent to, so that pumping action also occurs with regard to the outer volume area. As is shown in FIG. 12F and FIG. 12G, the sealing edges 36 of rotors 31 and 32 will eventually move away from the housing 20, so that the external volume area no longer appears divided into four separate units, but comprises a definite single volume that surrounds the rotors 31 and 32.

Figure 12G:
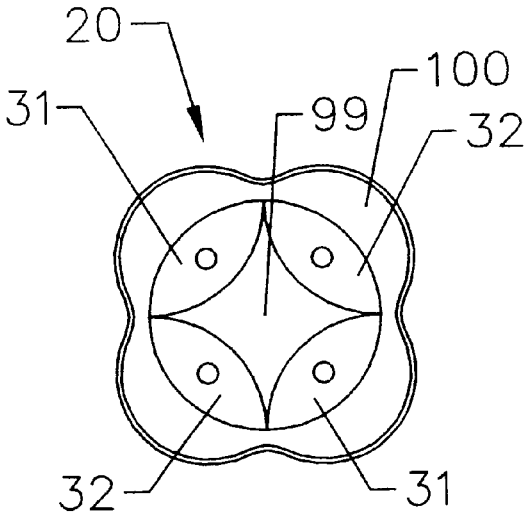
FIG. 12G is a top view of the rotor set and housing, where the rotors have turned 90 degrees from FIG. 12A.

Once the rotors 31 and 32 have concurrently rotated in the same direction 90 degrees, as show in FIG. 12G, the internal volume area 99 will be at a maximum volume, while the external volume area 100 will be at a minimum. At this point of rotation, both of the sealing edges 36 for each rotor 31 will be adjacent to the sealing edge 36 of the adjacent rotors 32, so that one of the arcual sides 35 and sealing edges 36 of each rotor 31 and 32 define the extent of the internal volume area 99.

Figure 12H:
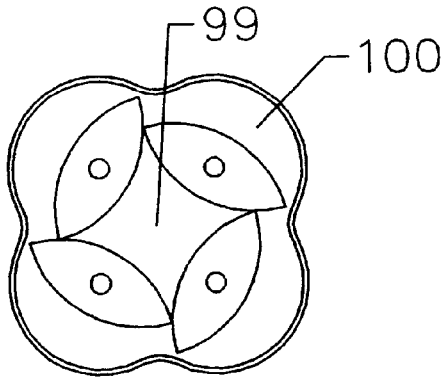
FIG. 12H is a top view of the rotor set and housing, where the rotors have turned 105 degrees from FIG. 12A.
Figure 12I:
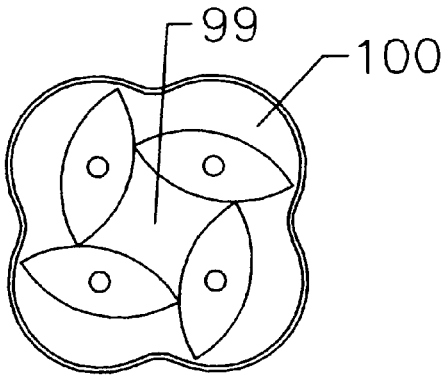
FIG. 12I is a top view of the rotor set and housing, where the rotors have turned 120 degrees from FIG. 12A.
Figure 12J:
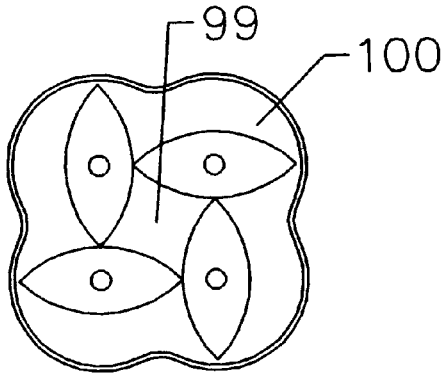
FIG. 12J is a top view of the rotor set and housing, where the rotors have turned 135 degrees from FIG. 12A.
Figure 12K:
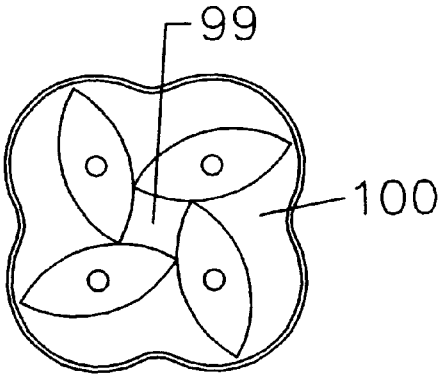
FIG. 12K is a top view of the rotor set and housing, where the rotors have turned 150 degrees from FIG. 12A.
Figure 12L:
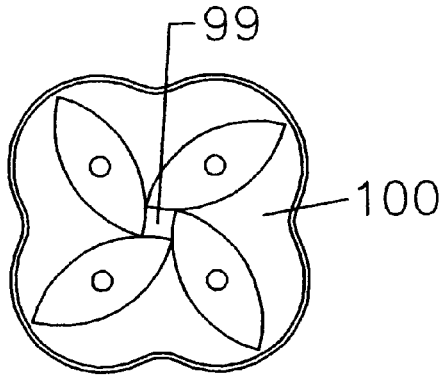
FIG. 12L is a top view of the rotor set and housing, where the rotors have turned 165 degrees from FIG. 12A.

As the rotors 31 and 32 continue to rotate, FIGS. 12H through 12L show a decrease of inner volume area 99 as opposed to the outer volume area 100. Again, the sealing edge 36 of the rotors 31 and 32 move along adjacent arcual sides 35 and continue to provide a seal between the inner volume area 99 and the outer volume area 100. FIG. 12H shows a rotor rotation of 15 additional degrees from FIG. 12G, and a rotation of 105 degrees as compared with FIG. 12A. FIG. 12I shows a rotation of 15 additional degrees from FIG. 12H, and a rotation of 120 degrees as compared with FIG. 12A. FIG. 12J shows a rotation of 15 additional degrees from FIG. 12I, and a rotation of 135 degrees as compared with FIG. 12A. FIG. 12K shows a rotation of 15 additional degrees from FIG. 12J, and a rotation of 150 degrees as compared with FIG. 12A. FIG. 12L shows a rotation of 15 additional degrees from FIG. 12K, and a rotation of 165 degrees as compared with FIG. 12A. An additional rotation of 15 degrees will return the configuration to that shown in FIG. 12A, being a rotor rotation of 180 degrees from FIG. 12A.

Figure 13B:
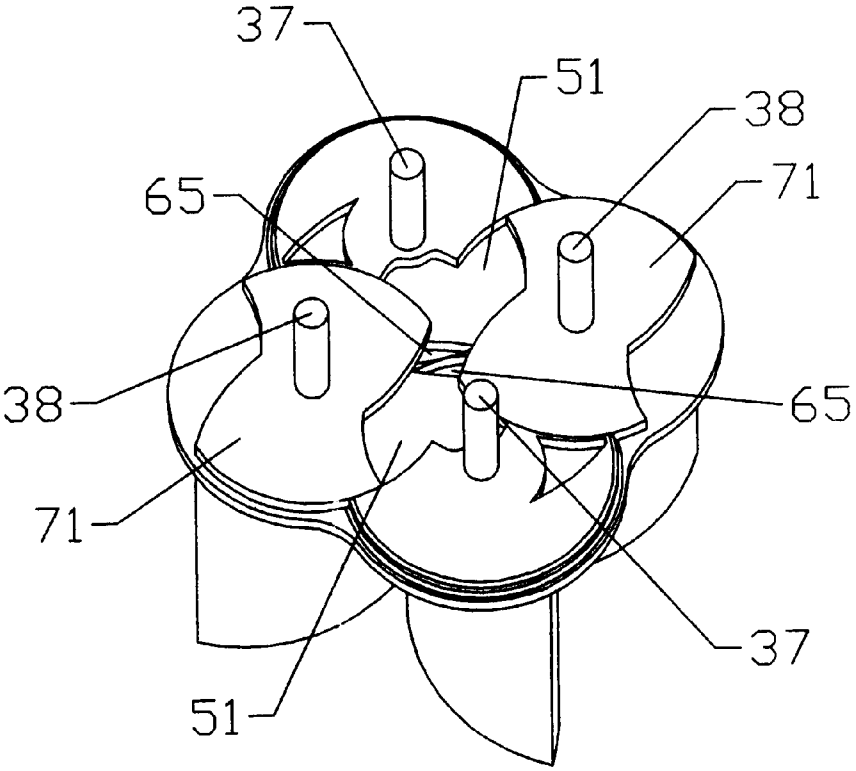
FIG. 13B is a perspective view of the rotor set and valve system, where the rotors have turned 15 degrees from FIG. 13A.
Figure 13A:
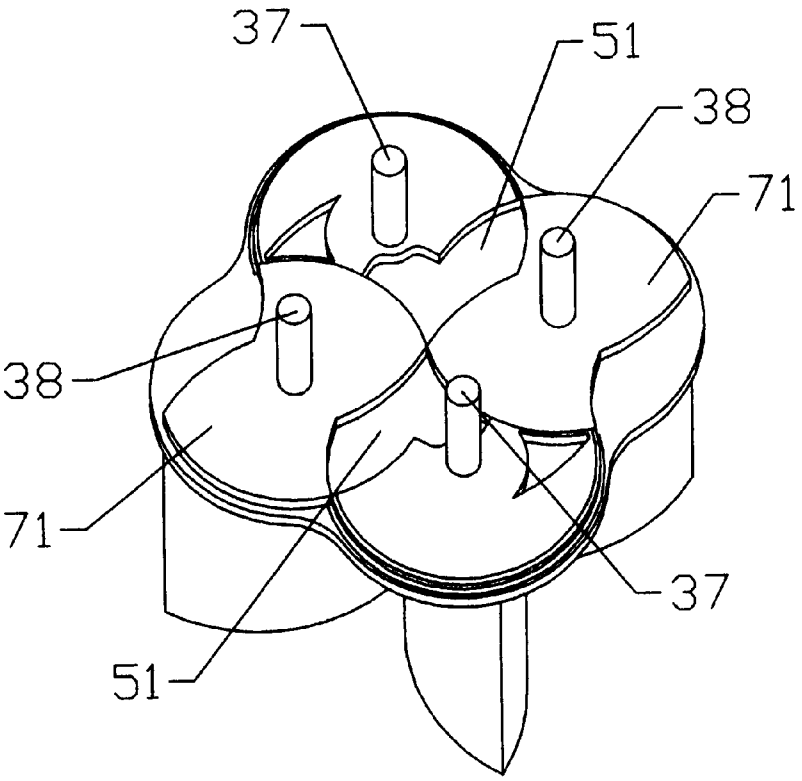
FIG. 13A is a perspective view of the rotor set and valve system, where the rotors define a minimal internal area, and where the rotors are defined to be situated at zero degrees rotation.

Referring now to FIG. 13A through FIG. 13L, a perspective view of the rotation of rotors 31 and 32, as well as primary top disks 51 within the primary disk guides 83 of the end plate 80, and secondary top disks 71, are shown. FIG. 13A shows the positions of rotors 31 and 32 as is shown in FIG. 12A. No apertures 56, 57, or gaps 65 are present, and thus no inlet is provided into the inner volume area. As rotation of 15 degrees occurs, with the rotors 31 and 32 oriented as shown in FIG. 12B, rotation of the secondary top disks 71 and primary top disks 51 will likewise occur, as shown in FIG. 13B. As the rotation begins, an aperture or inlet is made available to the slightly expanding inner volume area 99, through gaps 65 which begin to move from underneath the secondary top disks 71. The gap 65 will allow fluid or gases to move from outside the apparatus into the inner volume area 99 as it begins to expand.

Figure 13D:
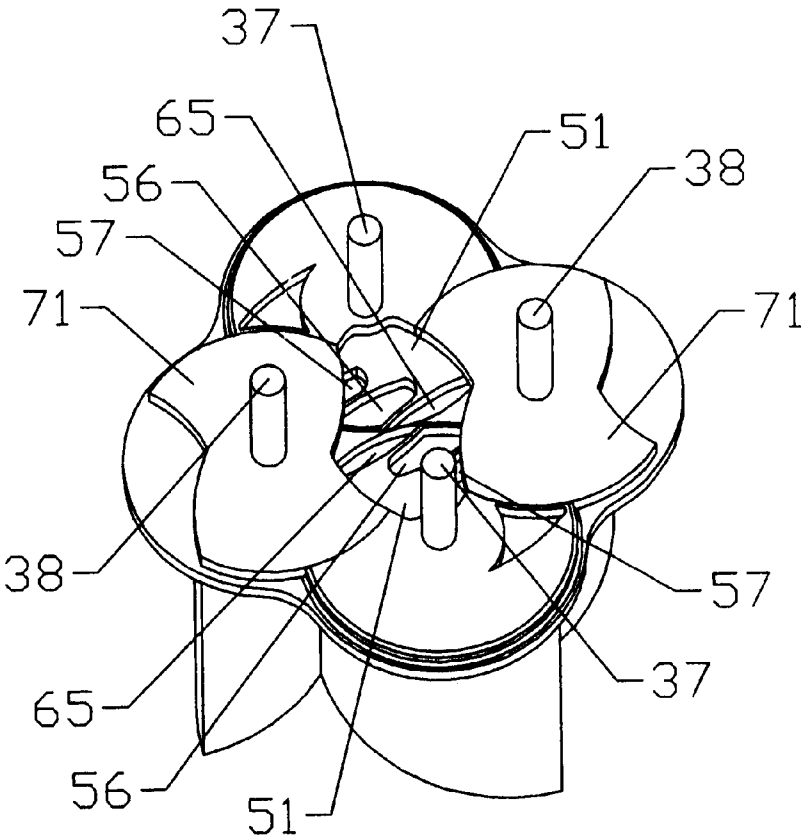
FIG. 13D is a perspective view of the rotor set and valve system, where the rotors have turned 45 degrees from FIG. 13A.
Figure 13C:
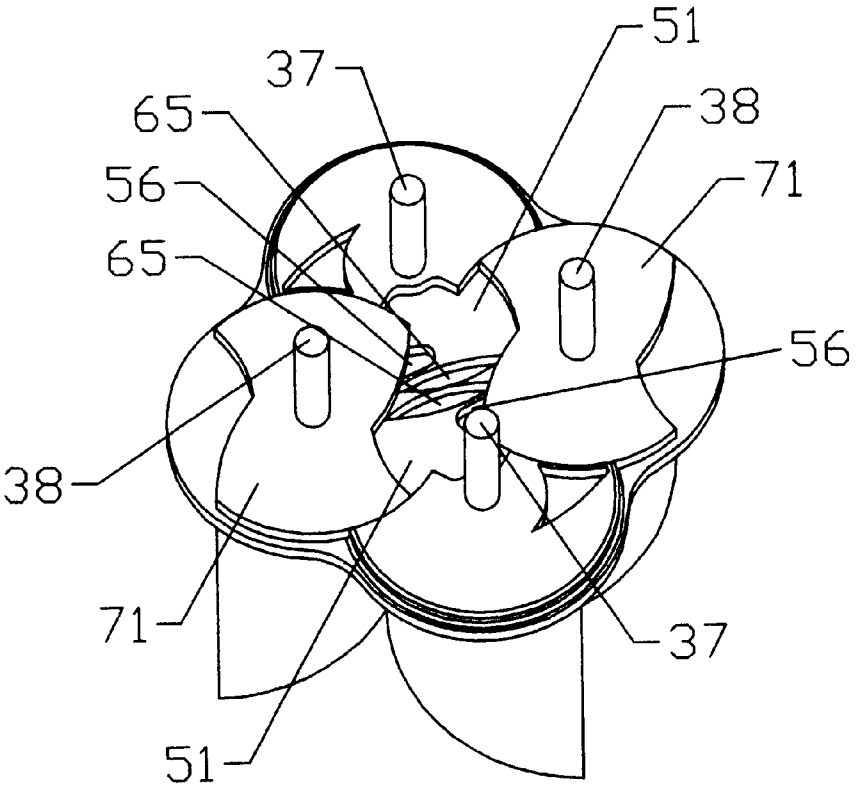
FIG. 13C is a perspective view of the rotor set and valve system, where the rotors have turned 30 degrees from FIG. 13A.

As further rotation occurs, such as an additional 15 degrees of rotation as shown in FIG. 13C, which has the same rotor 31 and 32 configuration shown in FIG. 12C, the gap 65 moves more fully across the inner volume area 99, and aperture 56 begins to also move in position above the inner volume area 99 so as to create a larger total inlet opening, to allow movement of liquids or gases into the inner volume area 99, as the primary top disks 51 and secondary top disks 71 rotate. As this rotation occurs, the primary top disks 51 rotate with their apertures 56 and 57 and gap 65 moving into position over the expanding inner volume area 99. The secondary top disks 71 are likewise rotating which define and limit the extent by which apertures 56 and 57, and gap 65, are exposed, so that they are only exposed at the point which they are positioned directly over the expanding inner volume area 99.

As FIG. 13D shows, the rotors 31 and 32 have now reached the rotation position as shown in FIG. 12D, so that the majority of gap 65, aperture 56 and at least part of aperture 57 are exposed over the inner volume area 99, and allow for a maximum inlet area to allow transfer of liquid or gas into the inner volume area 99. This is important, because at this point of rotation, the increase of the inner volume area 99 is expanding at the fastest volume rate during the rotation process. This change of the total inlet opening is constantly adjusting to the rate of expansion for the inner volume area 99. The inter-relational movement between the primary top disks 51 and the secondary top disks 71 continue to present a maximum amount of aperture openings 56, 57 and gap 65, when the transfer of fluid or gas would be at its highest rate.

Figure 13F:
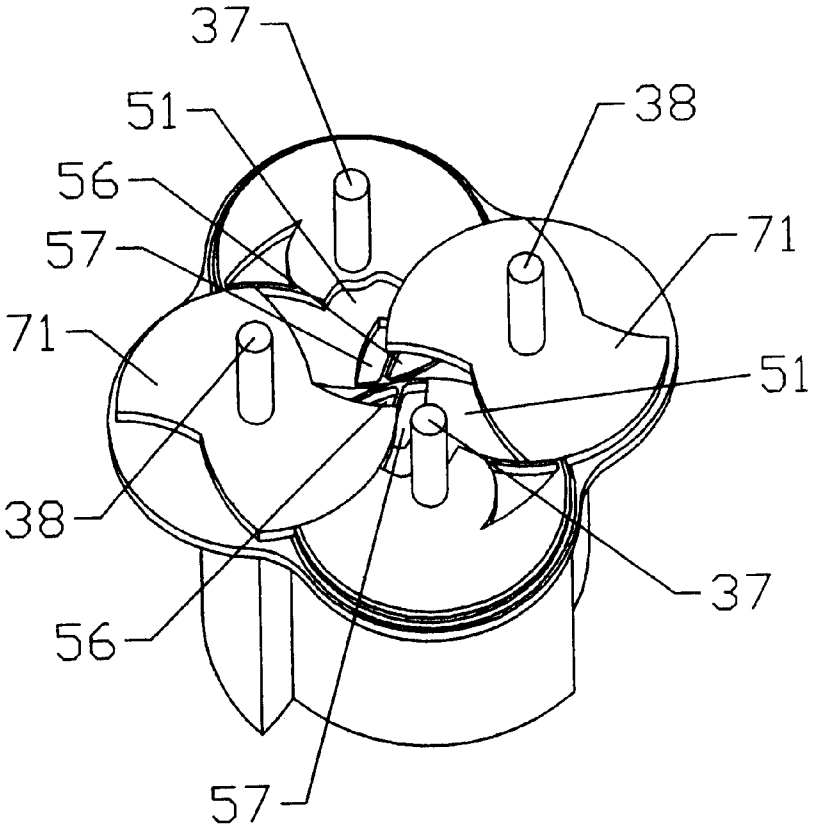
FIG. 13F is a perspective view of the rotor set and valve system, where the rotors have turned 75 degrees from FIG. 13A.
Figure 13E:
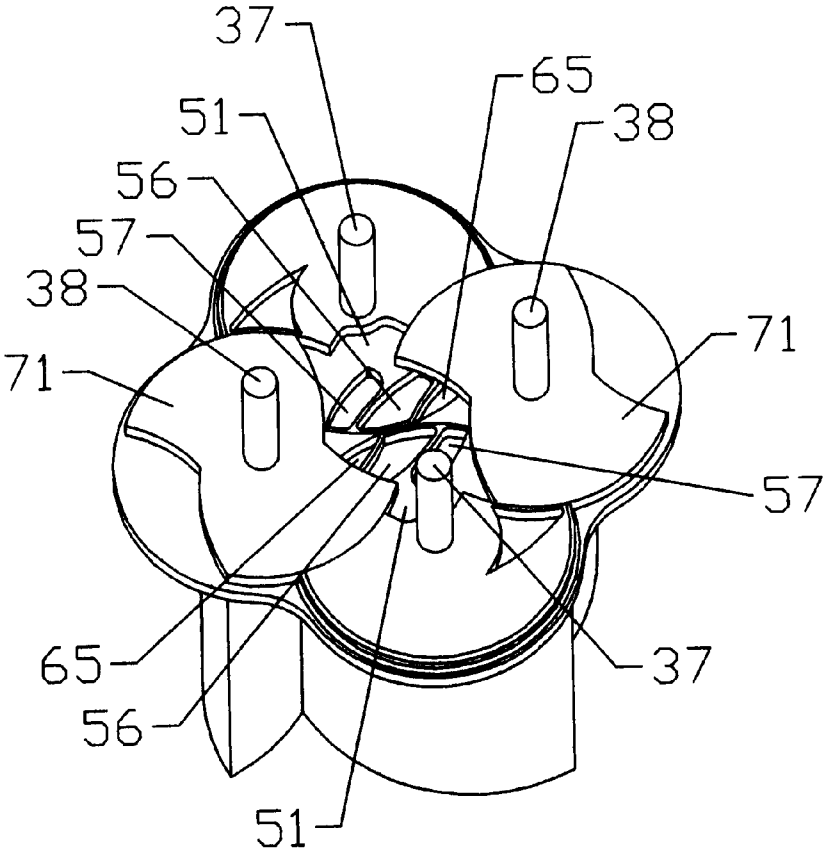
FIG. 13E is a perspective view of the rotor set and valve system, where the rotors have turned 60 degrees from FIG. 13A.

Referring now to FIG. 13E, the area of gap 65 has diminished as the gap 65 is rotating underneath the secondary top disks 71, while at the same time apertures 57 are moving out from underneath the secondary top disks 71, so as to keep the total inlet area at a maximum area to allow maximum gas or liquid transfer into the inner volume area 99. The rotor 31 and 32 configuration in FIG. 13E is the same as that shown for FIG. 12E.

Referring now also to FIG. 13F, the rotors 31 and 32 have rotated an additional 15 degrees, as compared with their position in FIG. 13E, resulting in the primary top disks 51 rotating underneath the advancing secondary top disks 71, resulting in the entire gap 65 now moving underneath the advancing secondary top disks 71, along with a portion of aperture 56, while aperture 57 is now fully exposed and positioned over the inner volume area 99, which is continuing to expand, but not at the same rate of expansion that was seen earlier. Apertures 56 and 57 provide the inlet for gas or liquid into the inner volume area as it continues to expand. The rotor 31 and 32 position in FIG. 13F is identical to that shown in FIG. 12F.

Figure 13H:
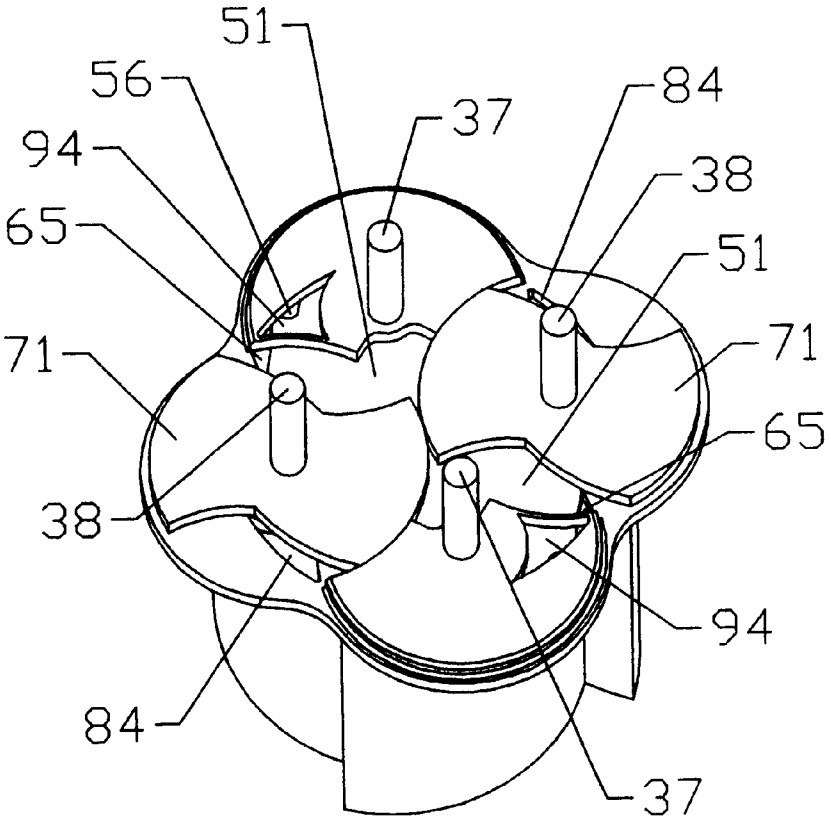
FIG. 13H is a perspective view of the rotor set and valve system, where the rotors have turned 105 degrees from FIG. 13A.
Figure 13G:
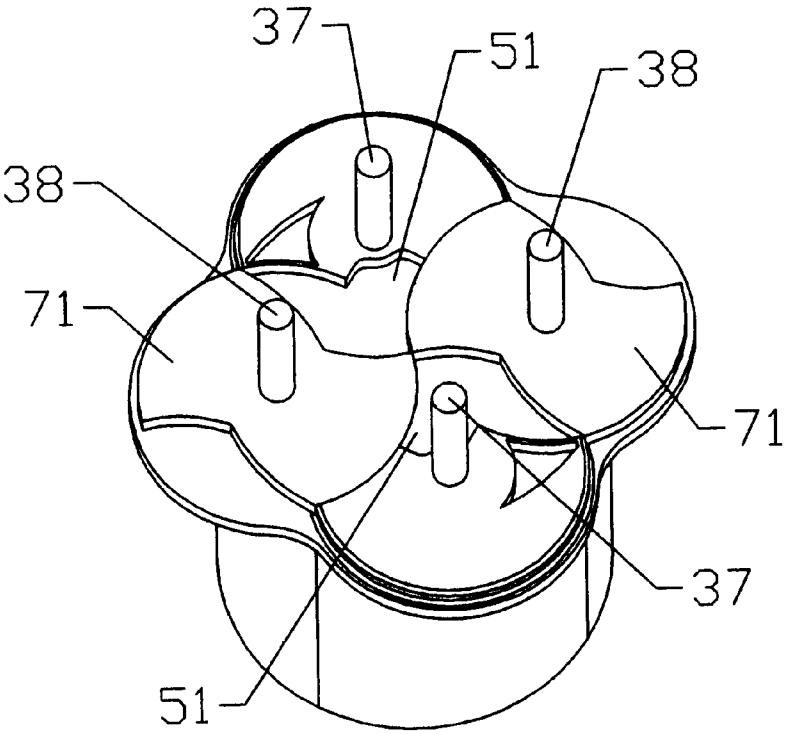
FIG. 13G is a perspective view of the rotor set and valve system, where the rotors have turned 90 degrees from FIG. 13A.

Referring now to FIG. 13G, the rotors 31 and 32 have rotated a total of 90 degrees from the position shown in FIG. 13A, as shown also in FIG. 12G, in which the inner volume area 99 has reached its maximum volume as defined by rotors 31 and 32. As the inner volume area 99 reaches its maximum volume, all inlet area provided by apertures 55 and 56 move fully under the secondary top disks 71 which are concurrently rotating over said apertures 55 and 56. As is shown in FIG. 13G, no movement of fluid or gas between the outside area and the inner volume area will occur.

Referring now to FIG. 13H, as the rotors 31 and 32 continue to rotate an additional 15 degrees from that shown in FIG. 13G, to the rotor configuration in FIG. 13H and also in FIG. 12H, compression of the inner volume area will begin to occur, and at the same time, expansion of the outer volume area 100 will begin to take place. As is shown in FIG. 13H, the secondary top disks 71 rotate and begin to uncover the end plate stationery aperture 84, which is also shown in FIG. 5. As the stationery aperture 84 is positioned so that it is above the external volume area 100 during this point of the rotor 31 and 32 rotation, transfer of fluid or gas into the external volume area 100 is able to begin.

It should be understood, that with the configuration of the primary top disks 51, as shown in FIG. 8, and secondary top disks as shown in FIG. 11, that the following figures relate to each other according to their position on the top of the rotors 31 and 32, or of the bottom of the rotors 31 and 32. In this manner, fluid or gas will enter through the top of this apparatus 10, then be expelled out through the bottom. Therefore, when the rotors are in a top configuration as shown in 12A the primary top disks 51 and secondary top disks 71 will be in the configuration shown in FIG. 13A. At the same time, the bottom of this apparatus 10, also having an inverted set of disks 51 and 71 and end plate 80 will have a bottom configuration as shown in FIGS. 12A and 13A.

If rotors 37 and 38 turn clockwise on a top view of the apparatus 10, when turning the apparatus 10 over for a bottom view, it will appear that the rotors 37 and 38 rotate counter-clockwise. It is this difference in relative rotational direction, with regard to the top and bottom of the apparatus 10, that allows the pumping action to occur. The progression for a top view, shown in the successive FIGS. 12A through 12L, and 13A through 13L, is reversed, with regard to the bottom of the apparatus 10.

When the rotor 31 and 32 configuration shown and described in FIGS. 13H and 12H above, is the configuration for the top of the apparatus 10, the bottom of the apparatus will have the configuration as depicted by FIGS. 13F and 12F. Table I below is illustrative of the forward progression from a top view, and a reverse progression from a bottom view, showing the configurations of the top and bottom portion of this apparatus 10, considered simultaneously, which allows for a pumping action to occur.

TABLE I

Concurrent configurations

| Top view configuration (Figures showing) | Degree of rotation | Bottom view of configuration (Figures showing) |
|---|---|---|
| 12A and 13A | 0 | 12A and 13A |
| 12B and 13B | 15 | 12L and 13L |
| 12C and 13C | 30 | 12K and 13K |
| 12D and 13D | 45 | 12J and 13J |
| 12E and 13E | 60 | 12I and 13I |
| 12F and 13F | 75 | 12H and 13H |
| 12G and 13G | 90 | 12G and 13G |
| 12H and 13H | 105 | 11F and 13F |
| 12I and 13I | 120 | 12E and 13E |
| 12J and 13J | 135 | 12D and 13D |
| 12K and 13K | 150 | 12C and 13C |
| 12L and 13L | 165 | 12B and 13B |
| 12A and 13A | 180 | 12A and 13A |

Figure 13J:
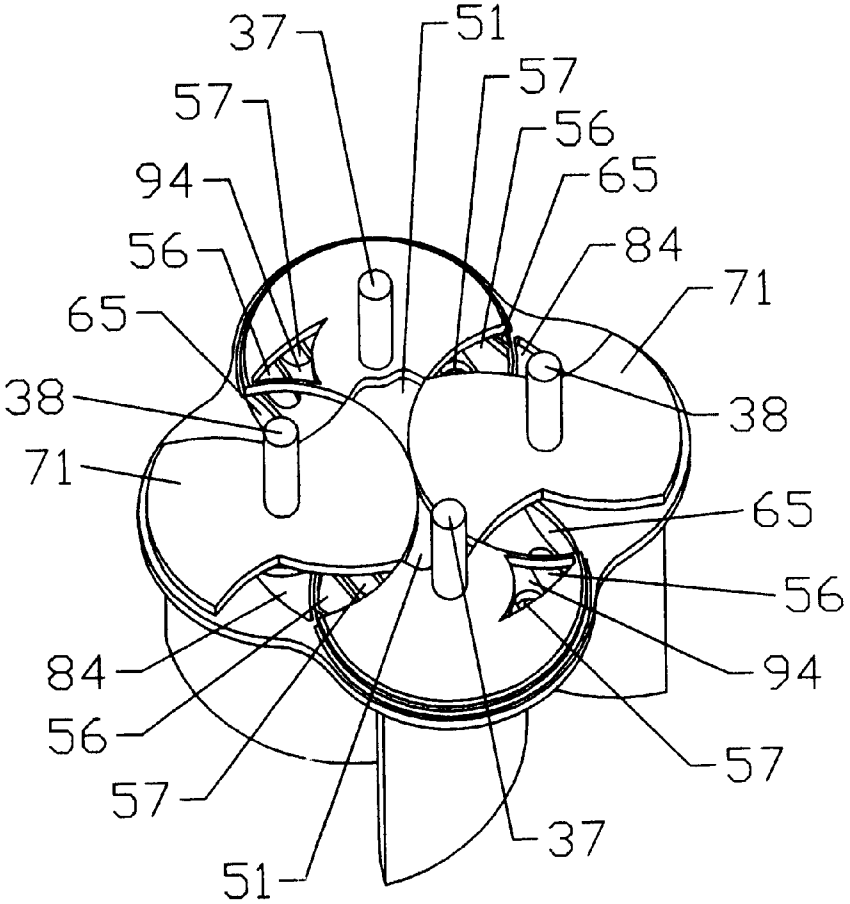
FIG. 13J is a perspective view of the rotor set and valve system, where the rotors have turned 135 degrees from FIG. 13A.
Figure 13I:
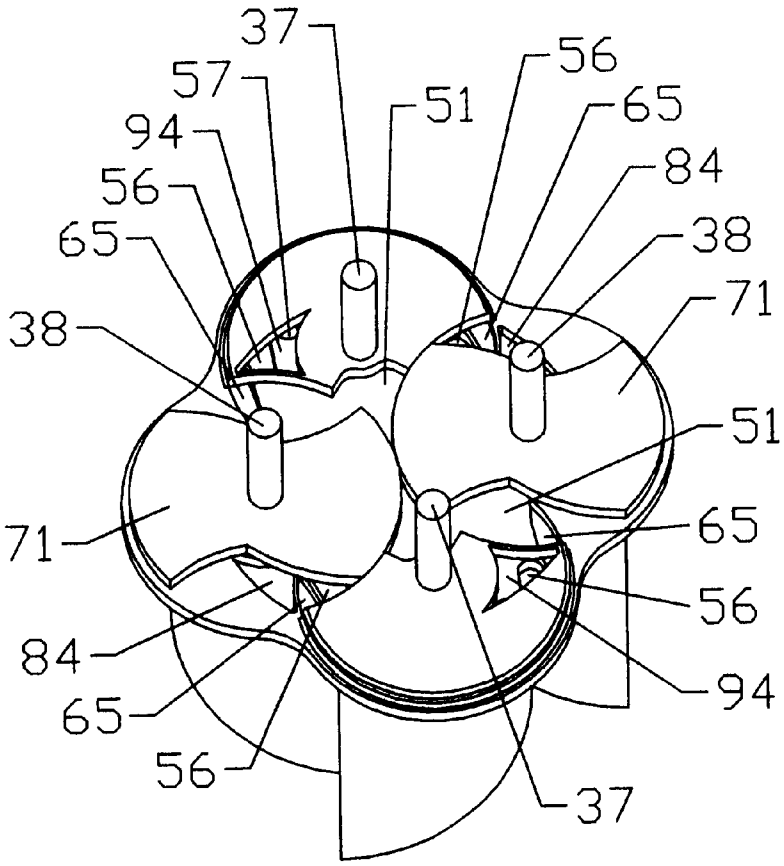
FIG. 13I is a perspective view of the rotor set and valve system, where the rotors have turned 120 degrees from FIG. 13A.

Referring now to FIG. 13I, which shows a rotor configuration also shown in FIG. 12I, both the stationary apertures 84, defined by the end plates 80, are now uncovered as the secondary top disks 71 continued to rotate. The gap 65 and a portion of the aperture 56 are also open from the outside to the external volume area 100. As the primary top disks 51 rotate, bringing the gap 65 and aperture 56 over the external volume area 100. Aperture 56 is open to the external volume area 100 due to it passing immediately under the cover plate stationary aperture 94, which is also shown in FIG. 6. This allows an inlet of increasing area to be defined, which allows sufficient transfer of fluid or gas into the external volume area 100, to account for its rapid increase in volume. The rotor 31 and 32 configuration shown and described in FIGS. 13I and 12I above, will be the configuration for the top of the apparatus 10, but the bottom of the apparatus will have the configuration as depicted by FIGS. 13E and 12E.

Referring now to FIG. 13J, which shows a rotor configuration also shown in FIG. 12J, the gap 65 and apertures 56 and 57 are more fully presented, so that maximum inlet area is made available for the passage of fluid or gases into the external volume area 100. The rotors 31 and 32 in the configuration shown and described in FIGS. 13J and 12J above, will be the configuration for the top of the apparatus 10, but the bottom of the apparatus will have the configuration as depicted by FIGS. 13D and 12D.

Figure 13L:
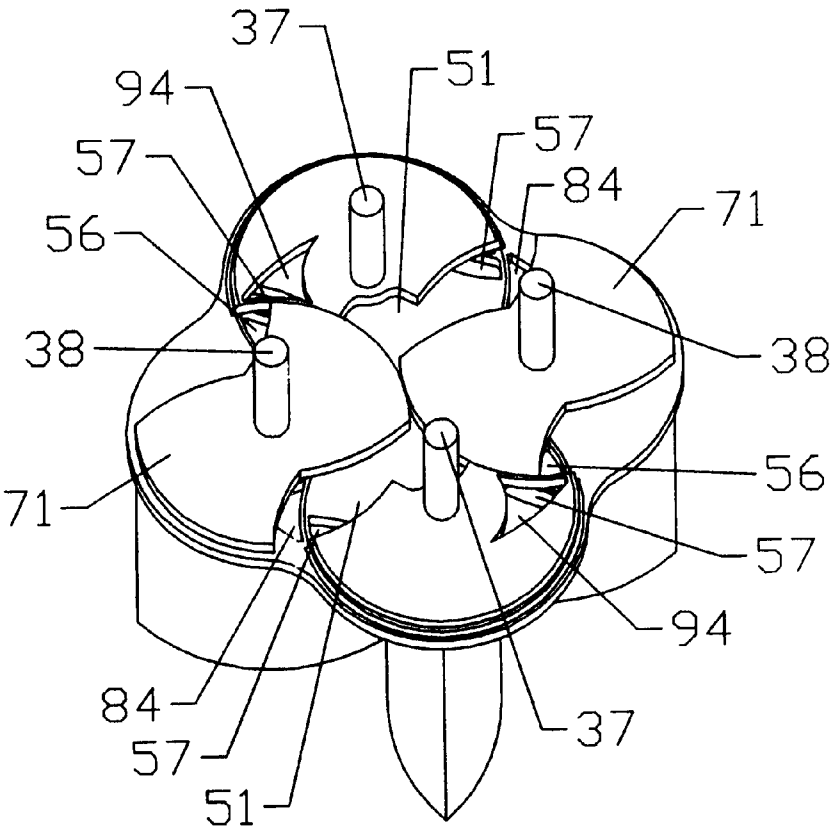
FIG. 13L is a perspective view of the rotor set and valve system, where the rotors have turned 165 degrees from FIG. 13A.
Figure 13K:
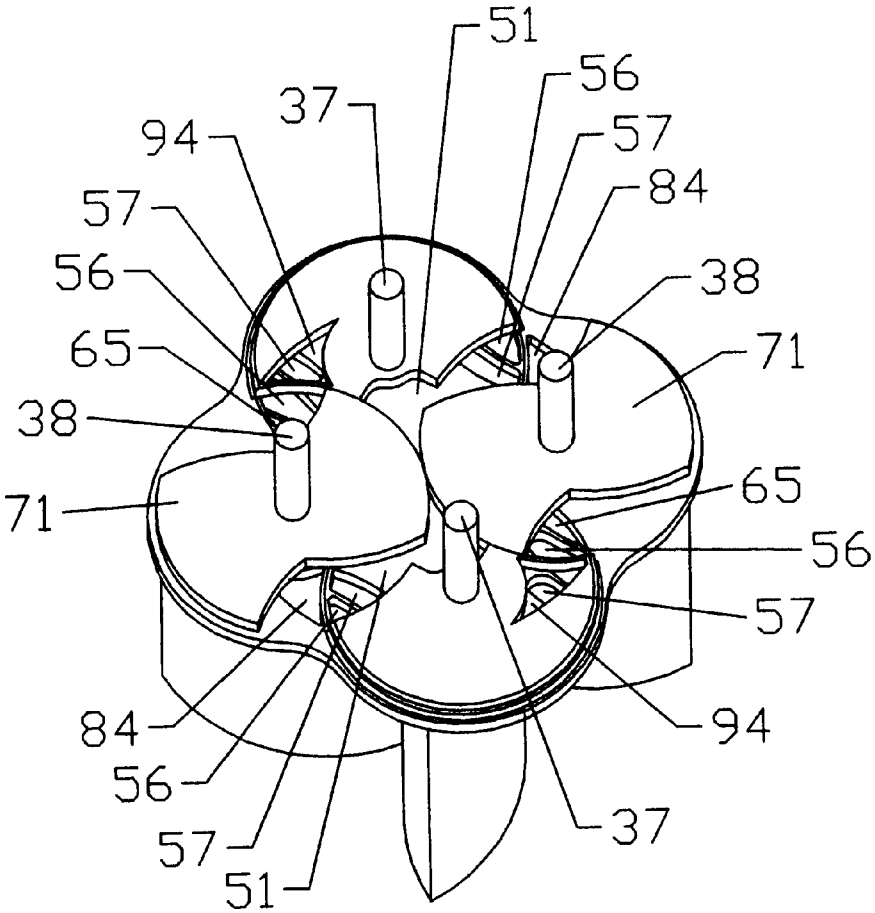
FIG. 13K is a perspective view of the rotor set and valve system, where the rotors have turned 150 degrees from FIG. 13A.

Referring now also to FIG. 13K, which shows a rotor configuration also shown in FIG. 12K, the inlet area defined by the total of the gap 65, and apertures 56 and 57 continues to be maintained as a constant opening size, with the inner volume area 99 fully covered. The rotors 31 and 32 in the configuration shown and described in FIGS. 13K and 12K above, will be the configuration for the top of the apparatus 10, but the bottom of the apparatus will have the configuration as depicted by FIGS. 13C and 12C.

Referring now also to FIG. 13L, which shows a rotor configuration also shown FIG. 12L, the external volume area 100 is reaching its maximum volume, showing a slowing increase of volume in relation to the rotors 31 and 32 rotation, and concurrently the inlets, defined by the end plate stationary apertures 84 and aperture 57, to the external volume area 100 are reducing in size. The end plate stationary aperture 84 is affected by the rotation of the secondary top disks 71 which are rotating over them, and which will fully cover them once the configuration shown in FIGS. 13A and 12A are again reached. The rotors 31 and 32 configuration shown and described in FIGS. 13L and 12L above, will be the configuration for the top of the apparatus 10, but the bottom of the apparatus will have the configuration as depicted by FIGS. 13B and 12B.

As the rotors 31 and 32 continue to rotate, they will return to the configuration as shown in FIGS. 13A and 12A on the top of the apparatus 10, with the bottom of the apparatus being configured as shown in FIGS. 13A and 12A.

Figure 14:
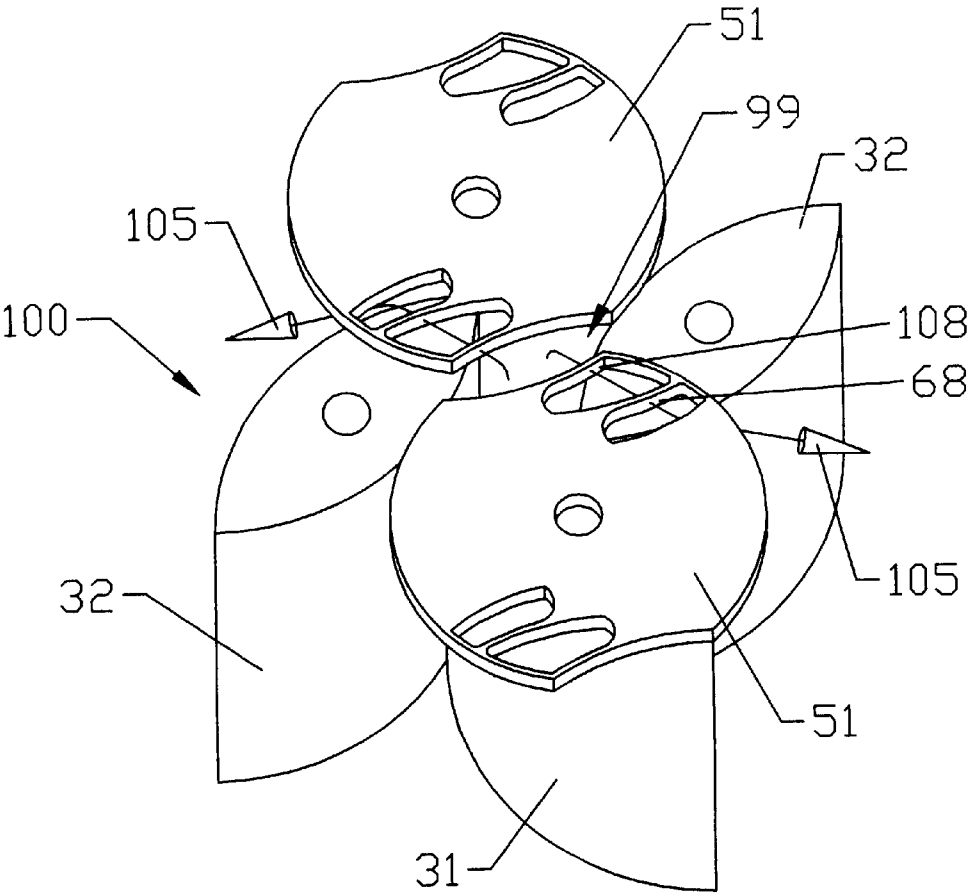
FIG. 14 is a perspective view of the rotor set, with two top disks shown, and where arrows designate the flow of gas or liquid vented from the internal displacement volume that would occur without the divider walls shown that separate the apertures.

The necessity of the secondary top disks 71 is shown in FIG. 14. In order to obtain the maximum inlet area, comprised of gaps 65 and apertures 56 and 57, said gaps 65 and apertures 56 and 57 should have as large of dimensions as possible. However, the overall width of the inlet provided by these apertures 56 and 57 and gaps 65 exceed the width of the rotors 31 and 32. As FIG. 14 shows, when the gap 65 and aperture 56 are over the inner volume area 99, part of aperture 57 is concurrently exposing the external volume area 100.

The aperture dividing walls 68 and 108 do not allow the transfer of fluid or gases in the path of travel shown as arrow 105. Fluids and gases are likewise prevented from circumventing said walls 107 and 108, by virtue of the top portion of rotors 32, and by the secondary top disk 71, which remains in the appropriate position to prevent any passageway from the inner volume area 99 to the outer volume area 100 using a combination of the apertures 56 and 57 or gap 65.

The cover plate stationery aperture 94, also shown in greater detail in FIG. 6, need not be defined as a triangular shaped opening, but only as a V-shaped notch. As is showing in FIGS. 13A through 13L, nothing passes over to the aperture 94, and thus the thin end wall 109 is not required. Preferably, the end wall 109 is used to maintain structural integrity.

Figure 15:
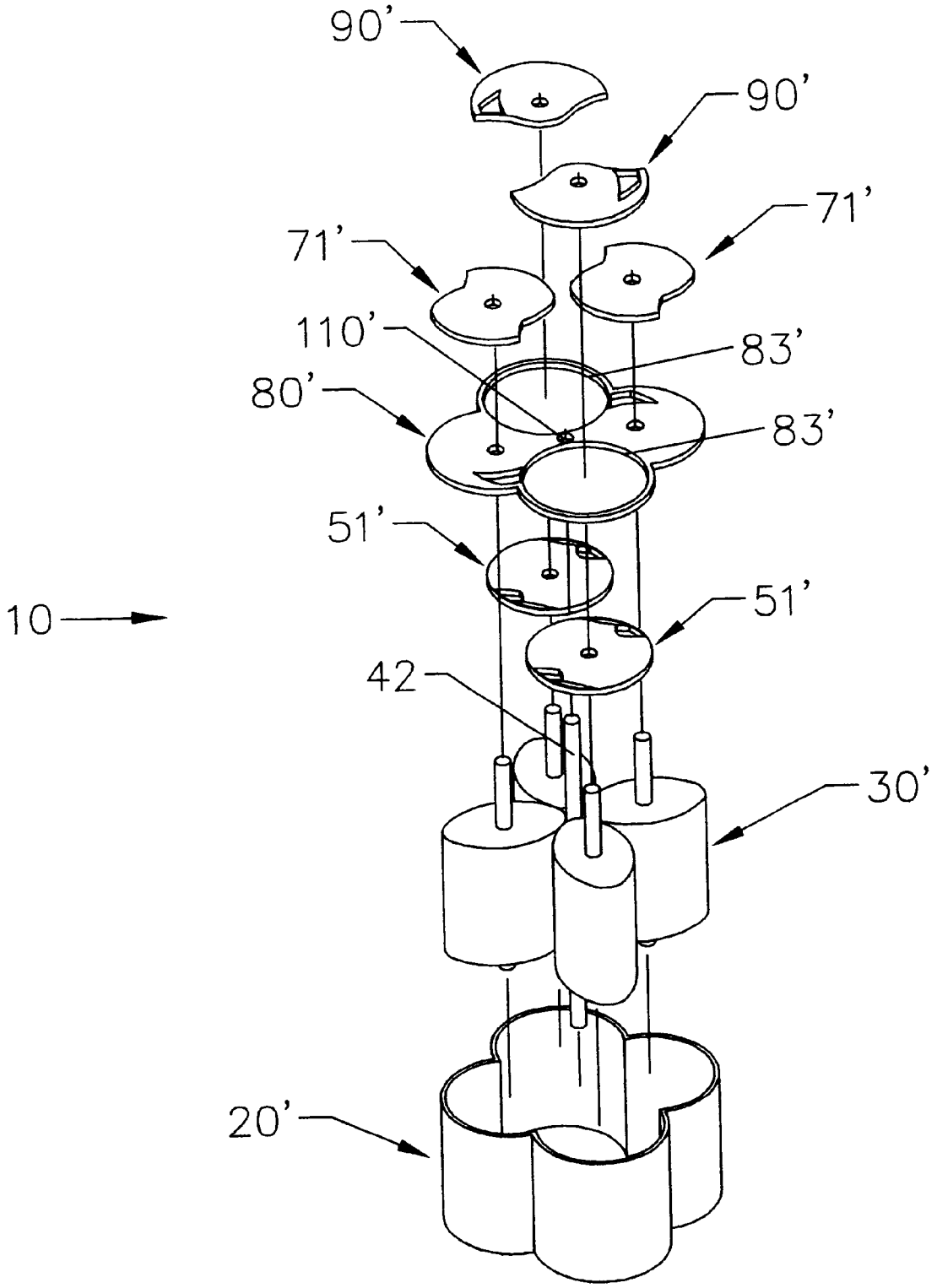
FIG. 15 is an exploded view of the apparatus, in which the rotor set comprise rotors having rounded or blunted sealing edges, as compared with FIG. 1, and where other parts have been modified to coordinate with the blunted rotors.

The shape of the rotors, is not required to conform to the shapes shown in FIGS. 1–4, 8, 10, 12A–12L, 13A–13L, and 14. In these figures, the rotors 31 and 32 are shown having pointed sharp sealing edges 36. As FIG. 15 shows, a rotor set 30' may have rotors with an oval shape, so that they define an internal volume area 99 which is able to accommodate an input/output shaft 42 through the entire length of the apparatus 10. In this case, the end plates 80' will have an input/output shaft hole 110' defined between the primary disk guide areas 83'.

As is also shown in FIG. 15, the housing 20' has been reconfigured to account for the changes in the rotor set 30'. Likewise, the extent of apertures and any defining gap made by the primary top disks 51' must be modified, to reflect the change in cross sectional measurement of the rotors they pass across. The end plate 80' has a defined center shaft hole 110', with the secondary top disks 71' being thicker, and having less area that they will allow to be exposed at any given time.

Figure 16:
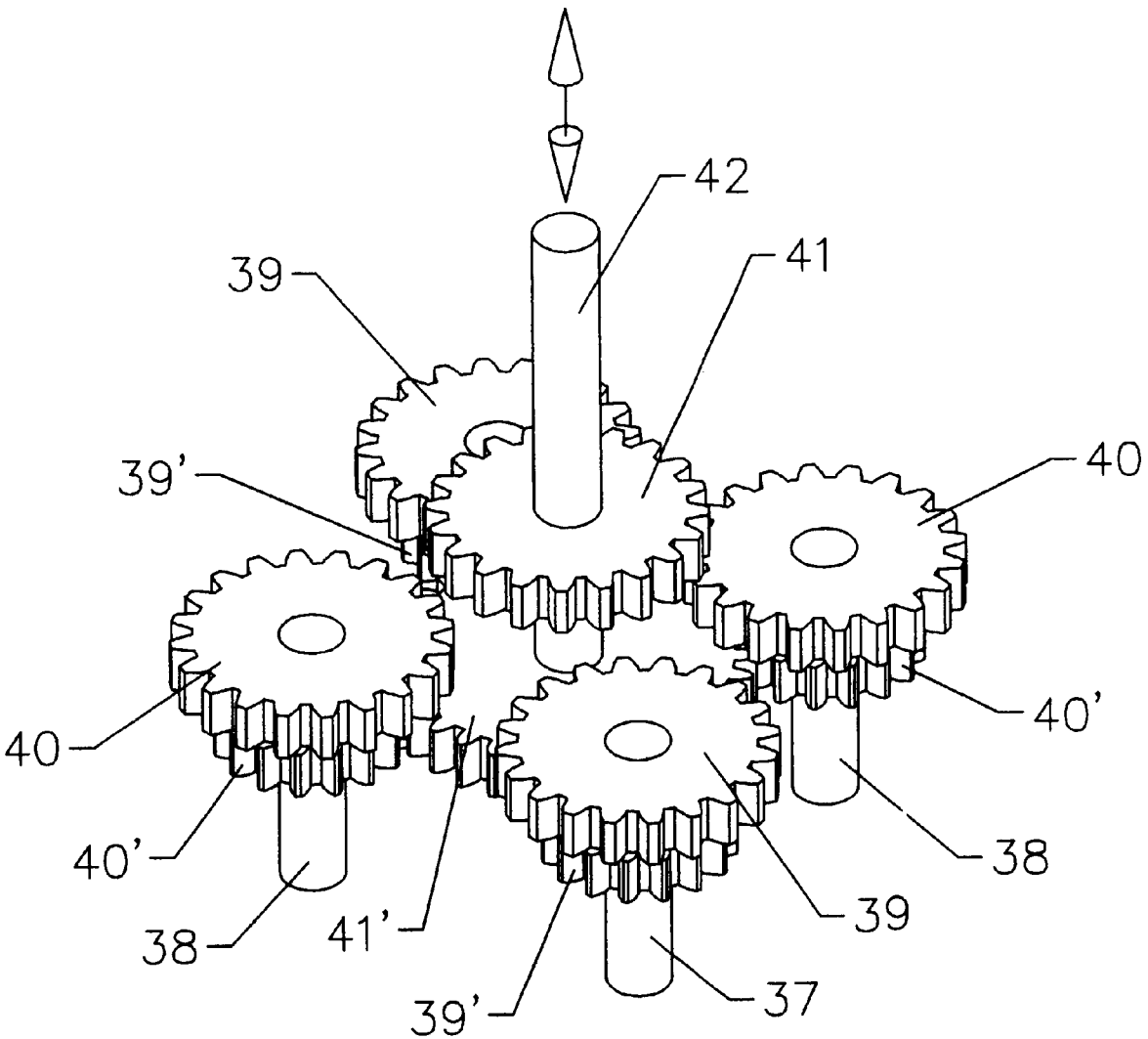
FIG. 16 is a perspective view of a gear assembly.
Figure 18:
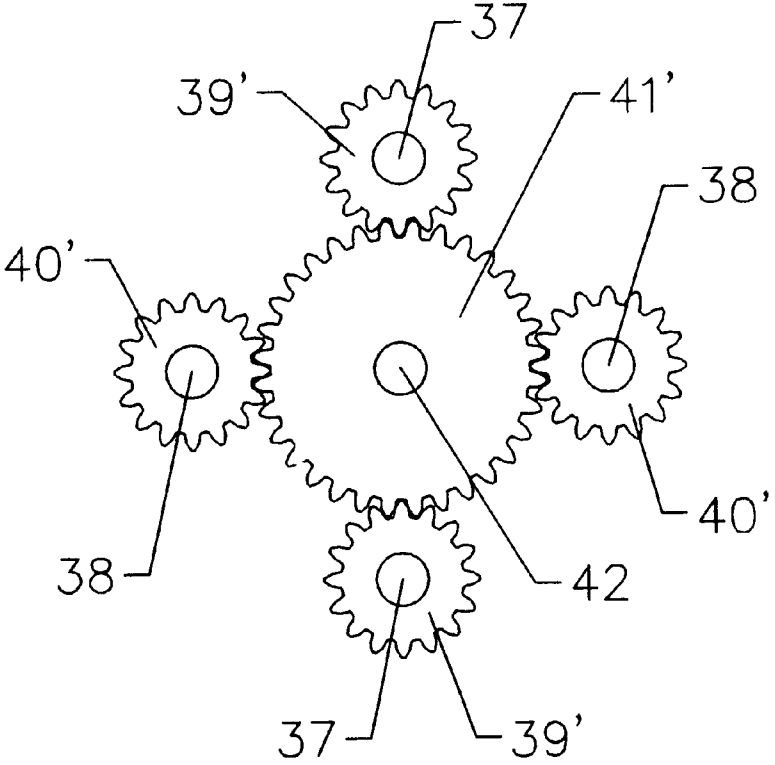
FIG. 18 is a top view of a gear assembly, in which the input/output shaft rotates more slowly as compared to the primary and secondary shafts.
Figure 17:
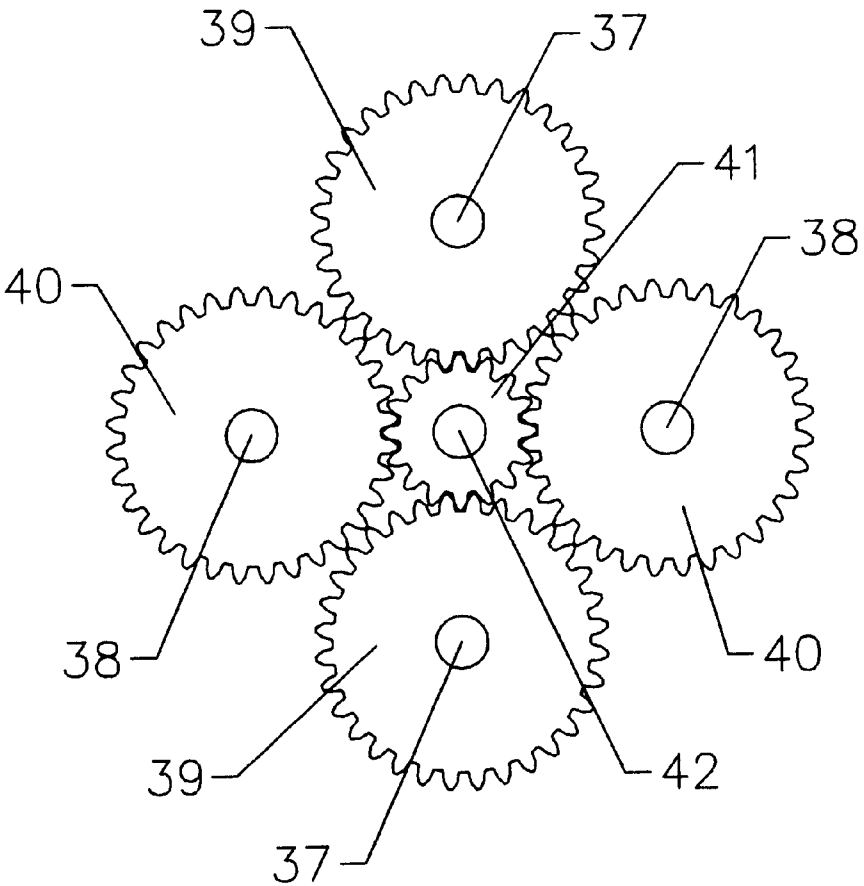
FIG. 17 is a top view of a gear assembly, in which the input/output shaft rotates faster as compared to the primary and secondary shafts.

Referring now to FIG. 16, a gear assembly is shown, which is also shown in part in conjunction with rotors 31 and 32 in FIG. 2. FIGS. 17 and 18 also provide a top view of two possible gear assemblies, which provide the transfer of rotor 31 and 32 rotational energy to a central shaft 42.

As is shown in FIG. 2, shafts 37 have a gear 39 affixed to said shaft 37, and shafts 38 have a gear 40 likewise affixed. Gears 39 and 40 have toothed edges 43, which moved against toothed edge 43 of input/output gear 41. Since gears 39 and 40 rotate in the same direction, they each provide energy to the input/output gear 41, which in turn provides rotational energy to an input/output shaft 42. As is shown in FIG. 2, the gears 39, 40 and 41 are all of similar size, so that rotational speed of any shaft 37 and 38 is that a speed similar to the rotation of input/output shaft 42.

Referring now to FIG. 17, gears 39 and 40 have a greater circumference then the input/output gear 41, which causes said input/output gear 41 to rotate much more rapidly then the surrounding gears 39 and 40. Another configuration is exampled in FIG. 18, in which gears 39' and 40' are diminished in size with regard to the input/output gear 41', so that the rotational speed of the input/output gear 41' is slower then the rotational speed of gears 39' and 40'.

Referring now to FIG. 16, the combination of the gear sets shown in FIG. 17 and FIG. 18 is shown. In this configuration, the input/output shaft 42 has two input/output gears 41 and 41' where said gears 41 and 41' are spaced apart along said input/output shaft 42. Input/output gear 41' engages gears 39' and 40', to cause a slower input/output rotational speed of shaft 42, with regard to the rotational speed of shafts 37 and 38.

By urging shaft 42 downward, so that gear 41 engages gears 39 and 40, the input/output rotational speed of shaft 42 will be increased, without any increase in the rotation speed of shafts 37 and 38. Various gear ratios can be used, and this description and accompanying figures should in no way be interpreted as a limitation on the available gear configurations.

Figure 19:
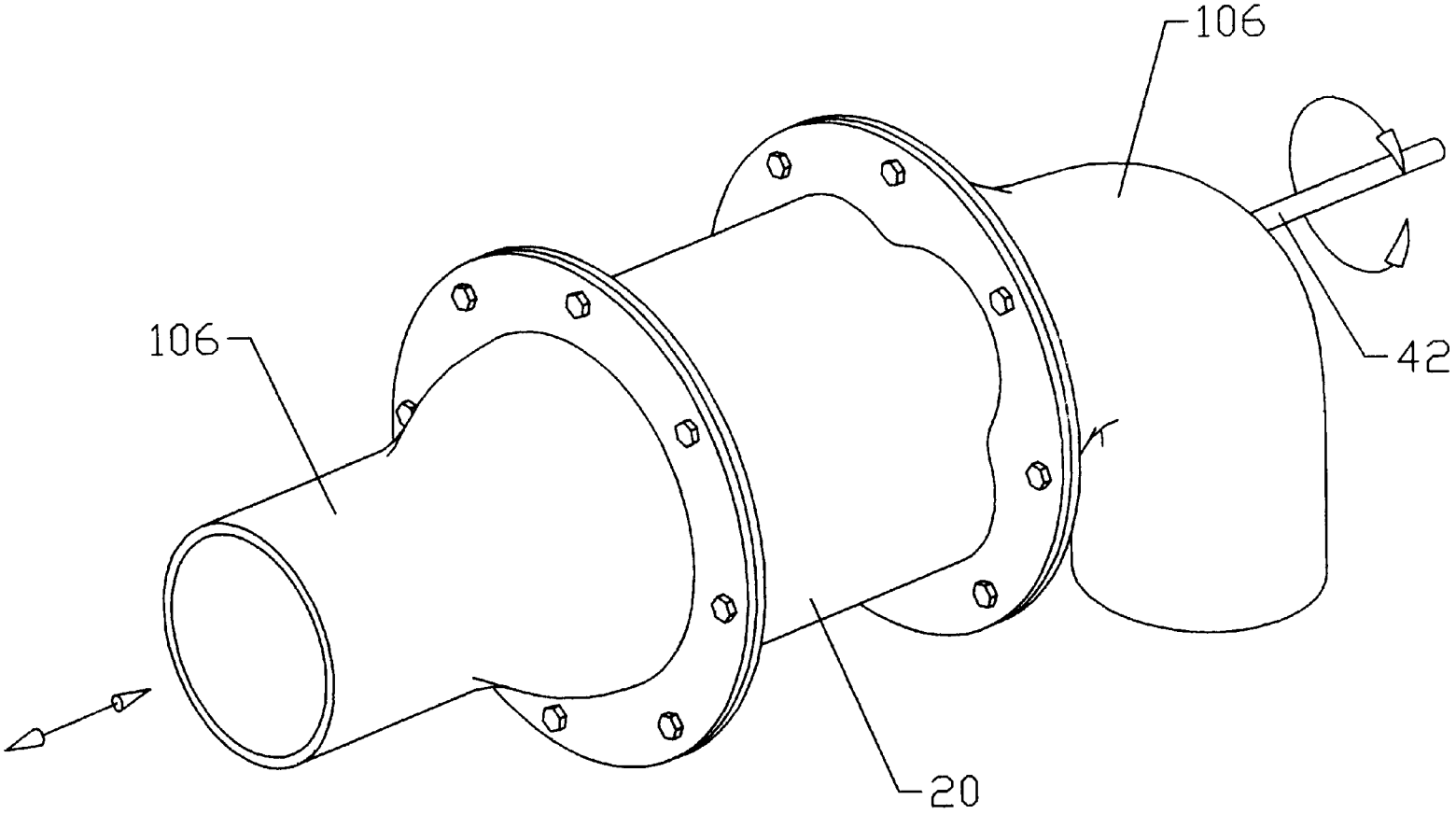
FIG. 19 is a perspective view of the outer side of the housing, showing a possible configuration for this invention within a tubular pipe system.

The input/output shaft 42 may be used to both deliver rotational energy to a rotor set 30, as well as obtaining rotational energy from the flow of liquid or gas through the apparatus 10. Referring now also to FIG. 19, a pipe 106 through which flows liquid or gas is shown, having a housing 20 comprising a portion of the section of said pipe 106. In such a configuration, the input/output shaft 42, which protrudes outward from an elbow joint within the length of pipe 106, provides either the power to pump liquids or gases, or to receive rotational energy from the flow of same liquids or gases This invention has the ability to function as an engine, where the expanding and decreasing volumes, and the components described above that comprise the rotors and valve system are able to be used together with an ignition system to provide energy delivered through an input output shaft. For purposes of this discussion, the apparatus 10 has been described in terms of the pumping and turbine properties it has to offer, but this should not be construed that the workings of the above described parts are not intended to cover the usage of this invention as an engine. In fact, the ability of this apparatus 10, to spin at high speeds without appreciable unbalance, allows it to be incorporated with an ignition system and fuel delivery system as an excellent engine, as the valve system offers maximum efficiency, with a varying inlet/outlet port size, which changes in conjunction with the rate of expansion or compression of the volume area it is venting to. One advantage of this apparatus 10, is that the length and size of the rotors 31 and 32 is not restricted as to length. Optimization of the inner volume area and outer volume area, with the venting ability, as determined by the size of the varying apertures, is able to be tailored to each rotor size and length.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. A rotary pump apparatus and integrated valve system which has a vent opening size that varies according to the rate of volume increase or decrease in the inner volume and outer volume, comprising:

a. two primary rotors, having primary rotor shafts;

b. two secondary rotors, having secondary rotor shafts, where said primary rotors are arranged so that they are each set at 90 degrees from the secondary rotors, and spaced so that the sealing edges of each rotor will move along arcual sides of the adjacent rotors during concurrent rotation;

c. a valve set having primary disk top covers, fixed in position along the primary rotor shaft at the top of each primary rotor, where each said primary cover defines at least two apertures each set at 180 degrees from each other along the circumferential edge of said primary top cover, and which rotate within defined primary disk guides of an end plate, with secondary top disks fixed to the secondary rotor shafts, and which rotate immediately above said primary disks, and a non rotating cover plate, fixed above the rotating secondary disks; and d. a housing, into which the rotors are placed, with the open end of said housing closed off by said end plate and valve set, where said rotor set defines an inner and outer volume within said housing.

2. A rotary pump apparatus and integrated valve system which has to a vent opening size that varies according to the rate of volume increase or decrease in the inner volume and outer volume, as described in claim one, in which the valve set is defined only on the top side of the rotors.

3. A rotary pump apparatus and integrated valve system which has a vent opening size that varies according to the rate of volume increase or decrease in the inner volume and outer volume, as described in claim one, in which the valve set is defined on the top side of the rotors and also on the bottom side of said rotors, with the bottom side having the primary disks and secondary disks oriented so that they are upside down in relation to the primary and secondary top disks.

4. A rotary pump apparatus and integrated valve system which has a vent opening size that varies according to the rate of volume increase or decrease in the inner volume and outer volume, as described in claim one, in which the top cover defines an opening that allows venting of the outer volume area during part of the rotor rotation.

5. A rotary pump apparatus and integrated valve system which has a vent opening size that varies according to the rate of volume increase or decrease in the inner volume and outer volume, as described in claim one, in which the primary top cover defines multiple apertures when it is placed within the primary disk guide, where said apertures are moved over the inner volume area, and outer volume area during portions of the rotor rotation.

6. A rotary pump apparatus and integrated valve system which has a vent opening size that varies according to the rate of volume increase or decrease in the inner volume and outer volume, as described in claim one, in which the primary top disk has multiple apertures which are separated by a divider wall, which prevent venting from the outer volume area into the inner volume area through the defined apertures in the primary top disk, when said apertures are concurrently over both the inner and outer volume areas.

7. A rotary pump apparatus and integrated valve system which has a vent opening size that varies according to the rate of volume increase or decrease in the inner volume and outer volume, as described in claim one, in which the secondary top disks have a shape that when rotated, cover and seal the apertures of the primary top disk during part of the rotor rotation.

8. A rotary pump apparatus and integrated valve system which has a vent opening size that varies according to the rate of volume increase or decrease in the inner volume and outer volume, as described in claim one, in which said end plate defines stationary apertures, which allow venting of the outer volume area when they are uncovered by the secondary top disks during rotation.

9. A rotary pump apparatus and integrated valve system which has a vent opening size that varies according to the rate of volume increase or decrease in the inner volume and outer volume, as described in claim one, in which the rotors have arcual sides and pointed sealing edges.

10. A rotary pump apparatus and integrated valve system which has a vent opening size that varies according to the rate of volume increase or decrease in the inner volume and outer volume, as described in claim one, in which the rotors have arcual sides and rounded sealing edges.

11. A rotary pump apparatus and integrated valve system which has a vent opening size that varies according to the rate of volume increase or decrease in the inner volume and outer volume, as described in claim one, in which the primary top disks and end plate have the same thickness.

12. A rotary pump apparatus and integrated valve system which has a vent opening size that varies according to the rate of volume increase or decrease in the inner volume and outer volume, as described in claim one, in which the rotor shafts have gears affixed to them above the valve set, which turn a geared input/output shaft.

13. A rotary turbine apparatus and integrated valve system which has a vent opening size that varies according to the rate of volume increase or decrease in the inner volume and outer volume, comprising:

a. two primary rotors, having primary rotor shafts;

b. two secondary rotors, having secondary rotor shafts, where said primary rotors are arranged so that they are each set at 90 degrees from the secondary rotors, and spaced so that the sealing edges of each rotor will move along arcual sides of the adjacent rotors during concurrent rotation;

c. a valve set having primary disk top covers, fixed in position along the primary rotor shaft at the top of each primary rotor, where each said primary cover defines at least two apertures, each set at 180 degrees from each other along the circumferential edge of said primary top cover, and which rotate within defined primary disk guides of an end plate, with secondary top disks fixed to the secondary rotor shafts, and which rotate immediately above said primary disks, and a non rotating cover plate, fixed above the rotating secondary disks; and d. a housing, into which the rotors are placed, with the open end of said housing closed off by said end plate and valve set, where said rotor set defines an inner and outer volume within said housing.

14. A rotary turbine apparatus and integrated valve system which has a vent opening size that varies according to the rate of volume increase or decrease in the inner volume and outer volume, as described in claim thirteen, in which the valve set is defined only on the top side of the rotors.

15. A rotary turbine apparatus and integrated valve system which has a vent opening size that varies according to the rate of volume increase or decrease in the inner volume and outer volume, as described in claim thirteen, in which the valve set is defined on the top side of the rotors and also on the bottom side of said rotors, with the bottom side having the primary disks and secondary disks oriented so that they are upside down in relation to the primary and secondary top disks.

16. A rotary turbine apparatus and integrated valve system which has a vent opening size that varies according to the rate of volume increase or decrease in the inner volume and outer volume, as described in claim thirteen, in which the top cover defines an opening that allows venting of the outer volume area during part of the rotor rotation.

17. A rotary turbine apparatus and integrated valve system which has a vent opening size that varies according to the rate of volume increase or decrease in the inner volume and outer volume, as described in claim thirteen, in which the primary top cover defines multiple apertures when it is placed within the primary disk guide, where said apertures are moved over the inner volume area, and outer volume area during portions of the rotor rotation.

18. A rotary turbine apparatus and integrated valve system which has a vent opening size that varies according to the rate of volume increase or decrease in the inner volume and outer volume, as described in claim thirteen, in which the primary top disk has multiple apertures which are separated by a divider wall, which prevent venting from the outer volume area into the inner volume area through the defined apertures in the primary top disk, when said apertures are concurrently over both the inner and outer volume areas.

19. A rotary turbine apparatus and integrated valve system which has a vent opening size that varies according to the rate of volume increase or decrease in the inner volume and outer volume, as described in claim thirteen, which the secondary top disks have a shape that when rotated, cover and seal the apertures of the primary top disk during part of the rotor rotation.

20. A rotary turbine apparatus and integrated valve system which has a vent opening size that varies according to the rate of volume increase or decrease in the inner volume and outer volume, as described in claim thirteen, in which said end plate defines stationary apertures, which allow venting of the outer volume area when they are uncovered by the secondary top disks during rotation.

21. A rotary turbine apparatus and integrated valve system which has a vent opening size that varies according to the rate of volume increase or decrease in the inner volume and outer volume, as described in claim thirteen, in which the rotors have arcual sides and pointed sealing edges.

22. A rotary turbine apparatus and integrated valve system which has a vent opening size that varies according to the rate of volume increase or decrease in the inner volume and outer volume, as described in claim thirteen, in which the rotors have arcual sides and rounded sealing edges.

23. A rotary turbine apparatus and integrated valve system which has a vent opening size that varies according to the rate of volume increase or decrease in the inner volume and outer volume, as described in claim thirteen, in which the primary top disks and end plate have the same thickness.

24. A rotary turbine apparatus and integrated valve system which has a vent opening size that varies according to the rate of volume increase or decrease in the inner volume and outer volume, as described in claim thirteen, in which the rotor shafts have gears affixed to them above the valve set, which turn a geared input/output shaft.

25. A rotary apparatus and integrated valve system which has a vent opening size that varies according to the rate of volume increase or decrease in the inner volume and outer volume, comprising:

a. two primary rotors, having primary rotor shafts;

b. two secondary rotors, having secondary rotor shafts, where said primary rotors are arranged so that they are each set at 90 degrees from the secondary rotors, and shaped with rounded sealing edges which move along arcual sides of the adjacent rotors during concurrent rotation, so as to define an inner volume area;

c. an input/output shaft positioned through the inner volume area, and through a defined aperture in an end plate;

d. a valve set having primary disk top covers, fixed in position along the primary rotor shaft at the top of each primary rotor, where each said primary cover defines at least two apertures, each set at 180 degrees from each other along the circumferential edge of said primary top cover, and which rotate within defined primary disk guides of an end plate, with secondary top disks fixed to the secondary rotor shafts, and which rotate immediately above said primary disks, and a non rotating cover plate, fixed above the rotating secondary disks; and e. a housing, into which the rotors are placed, with the open end of said housing closed off by said end plate and valve set, where said rotor set defines an inner and outer volume within said housing.

26. A rotary apparatus and integrated valve system which has a vent opening size that varies according to the rate of volume increase or decrease in the inner volume and outer volume, as described in claim twenty five, in which the valve set is defined only on the top side of the rotors.

27. A rotary apparatus and integrated valve system which has a vent opening size that varies according to the rate of volume increase or decrease in the inner volume and outer volume, as described in claim twenty five, in which the valve set is defined on the top side of the rotors and also on the bottom side of said rotors, with the bottom side having the primary disks and secondary disks oriented so that they are upside down in relation to the primary and secondary top disks.

28. A rotary apparatus and integrated valve system which has a vent opening size that varies according to the rate of volume increase or decrease in the inner volume and outer volume, as described in claim twenty five, in which the top cover defines an opening that allows venting of the outer volume area during part of the rotor rotation.

29. A rotary apparatus and integrated valve system which has a vent opening size that varies according to the rate of volume increase or decrease in the inner volume and outer volume, as described in claim twenty five, in which the primary top cover defines multiple apertures when it is placed within the primary disk guide, where said apertures are moved over the inner volume area, and outer volume area during portions of the rotor rotation.

30. A rotary apparatus and integrated valve system which has a vent opening size that varies according to the rate of volume increase or decrease in the inner volume and outer volume, as described in claim twenty five, in which the primary top disk has multiple apertures which are separated by a divider wall, which prevent venting from the outer volume area into the inner volume area through the defined apertures in the primary top disk, when said apertures are concurrently over both the inner and outer volume areas.

31. A rotary apparatus and integrated valve system which has a vent opening size that varies according to the rate of volume increase or decrease in the inner volume and outer volume, as described in claim twenty five, which the secondary top disks have a shape that when rotated, cover and seal the apertures of the primary top disk during part of the rotor rotation.

32. A rotary apparatus and integrated valve system which has a vent opening size that varies according to the rate of volume increase or decrease in the inner volume and outer volume, as described in claim twenty five, in which an end plate defines stationary apertures, which allow venting of the outer volume area when they are uncovered by the secondary top disks during rotation.

33. A rotary apparatus and integrated valve system which has a vent opening size that varies according to the rate of volume increase or decrease in the inner volume and outer volume, as described in claim twenty five, in which the primary top disks and end plate have the same thickness.

34. A rotary apparatus and integrated valve system which has a vent opening size that varies according to the rate of volume increase or decrease in the inner volume and outer volume, as described in claim twenty five, in which the rotor shafts have gears affixed to them above the valve set, which turn a geared input/output shaft.

* * * * *